US011925263B2

(12) United States Patent
Didyk

(10) Patent No.: US 11,925,263 B2
(45) **Date of Patent: *Mar. 12, 2024**

(54) DYNAMIC WORKSTATION APPARATUS, METHODS, AND SYSTEMS

(71) Applicant: William Didyk, Vancouver (CA)

(72) Inventor: William Didyk, Vancouver (CA)

( * ) Notice: Subject to any disclaimer, the term of this patent is extended or adjusted under 35 U.S.C. 154(b) by 0 days.

This patent is subject to a terminal disclaimer.

(21) Appl. No.: 17/921,921

(22) PCT Filed: May 3, 2021

(86) PCT No.: PCT/CA2021/050617

§ 371 (c)(1),
(2) Date: Oct. 27, 2022

(87) PCT Pub. No.: WO2021/223019

PCT Pub. Date: Nov. 11, 2021

(65) Prior Publication Data

US 2023/0165365 A1 Jun. 1, 2023

Related U.S. Application Data

(60) Provisional application No. 63/050,613, filed on Jul. 10, 2020, provisional application No. 63/019,873, filed on May 4, 2020.

(51) Int. Cl.

| | |
|---|---|
| ***A47B 9/04*** | (2006.01) |
| ***A63B 21/078*** | (2006.01) |
| *A63B 23/04* | (2006.01) |

(52) U.S. Cl.

CPC ..... *A47B 9/04* (2013.01); *A63B 21/078* (2013.01); *A47B 2200/0061* (2013.01);
(Continued)

(58) Field of Classification Search

CPC ..... A63B 2225/50; A63B 21/078; A63B 21/0783; A63B 2023/0411; A47B 9/04;
(Continued)

(56) References Cited

U.S. PATENT DOCUMENTS

| | | | |
|---|---|---|---|
| 2,844,428 | A | 7/1958 | Puntenney |
| 4,249,726 | A | 2/1981 | Faust |

(Continued)

FOREIGN PATENT DOCUMENTS

| | | | |
|---|---|---|---|
| CN | 106170321 | A | 11/2016 |
| DE | 3607365 | A1 | 9/1987 |

(Continued)

OTHER PUBLICATIONS

"Mount-It! Single Screen Dual-Pole Heavy-Duty Floor to Ceiling Mount." B & H Photo, Video, and Audio, Feb. 24, 2023, https://www.bhphotovideo.com/c/product/1744972-REG/mount_it_mi_20609_single_screen_dual_pole_heavy_duty_floor_to_ceiling.html. Online ad.

(Continued)

*Primary Examiner* — Matthew W Ing

(57) ABSTRACT

Aspects of dynamic workstation apparatus, methods, and systems are described. One aspect is a workstation apparatus that includes a frame including overhead frame elements defining a covered workspace. The apparatus may include a raisable and lowerable work surface that may be configured to be movably attached to the overhead frame elements and may be selectively positionable in the covered workspace at a plurality of different vertical heights including a standing height and a floor height. A first actuator may be attached to and operable with the frame to move the raisable and lowerable work surface between a range of movement including the standing height and the floor height while maintaining an orientation of the raisable and lowerable (Continued)

work surface relative to the frame such that the raisable and lowerable work surface may remain relatively level. Aspects of related methods and systems also are described.

23 Claims, 25 Drawing Sheets

(52) U.S. Cl.
CPC ..... *A47B 2200/0062* (2013.01); *A47B 2200/0071* (2013.01); *A63B 2023/0411* (2013.01); *A63B 2225/50* (2013.01)

(58) Field of Classification Search
CPC .... A47B 2200/0061; A47B 2200/0062; A47B 2200/0071
See application file for complete search history.

(56) References Cited

U.S. PATENT DOCUMENTS

| | | | |
|---|---|---|---|
| 4,286,782 | A | 9/1981 | Fuhrhop |
| 5,048,826 | A | 9/1991 | Ryan |
| 5,190,510 | A | 3/1993 | Goodger |
| 5,257,701 | A | 11/1993 | Edelson |
| 5,323,695 | A | 6/1994 | Borgman et al. |
| 5,605,311 | A | 2/1997 | McGrath et al. |
| 5,687,654 | A | 11/1997 | Huggins |
| 5,813,947 | A | 9/1998 | Densmore |
| 5,823,921 | A | 10/1998 | Dawson |
| 5,989,164 | A | 11/1999 | Kullman et al. |
| 5,989,166 | A | 11/1999 | Capizzo et al. |
| 6,248,048 | B1 | 6/2001 | Zuckerman et al. |
| 6,293,892 | B1 | 9/2001 | Slawinski et al. |
| 6,743,152 | B2 | 6/2004 | Weiss |
| 6,893,381 | B2 | 5/2005 | Slawinski |
| 6,926,649 | B2 | 8/2005 | Slawinski |
| 7,001,314 | B1 | 2/2006 | Hummer, Jr. |
| 7,169,097 | B1 | 1/2007 | Stearns |
| 7,677,678 | B2 | 3/2010 | Mosel et al. |
| 7,892,148 | B1 | 2/2011 | Stauffer |
| 7,963,886 | B1 | 6/2011 | Schwinn et al. |
| 8,337,370 | B2 | 12/2012 | Rogers et al. |
| 8,485,945 | B2 | 7/2013 | Leonhard |
| 8,870,720 | B1 | 10/2014 | Webber et al. |
| 8,965,541 | B2 | 2/2015 | Martinez et al. |
| 9,050,496 | B2 | 6/2015 | Towley, III et al. |
| 9,167,894 | B2 | 10/2015 | DesRoches et al. |
| 9,295,871 | B2 | 3/2016 | Luedeka |
| 9,327,160 | B2 | 5/2016 | Tauriainen |
| 9,403,048 | B2 | 8/2016 | Balandis et al. |
| 9,486,070 | B2 | 11/2016 | Labrosse et al. |
| 9,682,307 | B2 | 6/2017 | Dalebout |
| 9,723,920 | B1 | 8/2017 | Wu |
| 9,901,780 | B2 | 2/2018 | Deluca et al. |
| 9,907,396 | B1 | 3/2018 | Labrosse et al. |
| 9,925,403 | B1 | 3/2018 | Zarli |
| 10,174,515 | B1 | 1/2019 | Krivens |
| 10,258,150 | B2 | 4/2019 | Lin |
| 10,575,630 | B1 | 3/2020 | Poniatowski |
| 10,603,534 | B2 | 3/2020 | Taft et al. |
| 10,661,114 | B2 | 5/2020 | Watterson et al. |
| 10,827,829 | B1 | 11/2020 | Labrosse et al. |
| 10,864,400 | B2 | 12/2020 | Schween |
| 11,007,400 | B1 | 5/2021 | Stoddard et al. |
| 2002/0082145 | A1 | 6/2002 | Hamilton |
| 2004/0092369 | A1* | 5/2004 | Slawinski ..... A63B 21/078 482/93 |
| 2006/0230992 | A1 | 10/2006 | Newhouse et al. |
| 2007/0099773 | A1 | 5/2007 | Hummer |
| 2008/0070759 | A1 | 3/2008 | Chaulk |
| 2008/0096745 | A1 | 4/2008 | Perry |
| 2008/0245279 | A1 | 10/2008 | Pan |
| 2009/0127993 | A1* | 5/2009 | Hrubesch ..... F25D 25/02 312/408 |
| 2009/0261704 | A1* | 10/2009 | Benz ..... F24C 15/16 312/293.1 |
| 2011/0082013 | A1 | 4/2011 | Bastian |
| 2013/0150214 | A1 | 6/2013 | Wu |
| 2014/0213414 | A1 | 7/2014 | Balandis et al. |
| 2015/0165256 | A1 | 6/2015 | Salamon et al. |
| 2016/0037909 | A1 | 2/2016 | Maas et al. |
| 2017/0106235 | A1 | 4/2017 | Carter et al. |
| 2018/0117382 | A1 | 5/2018 | Johanson et al. |
| 2020/0188726 | A1 | 6/2020 | Carter et al. |
| 2020/0367644 | A1 | 11/2020 | Laudadio et al. |
| 2021/0046354 | A1 | 2/2021 | Oaks |
| 2021/0339079 | A1 | 11/2021 | Dalebout et al. |
| 2021/0394011 | A1 | 12/2021 | Neuhaus et al. |
| 2022/0062738 | A1 | 3/2022 | Neuhaus et al. |
| 2022/0233907 | A1 | 7/2022 | Cobb |
| 2022/0233908 | A1 | 7/2022 | Neuhaus et al. |

FOREIGN PATENT DOCUMENTS

| | | | |
|---|---|---|---|
| WO | 1991007212 | A1 | 5/1991 |
| WO | 2011156046 | A2 | 12/2011 |
| WO | 2012177919 | A2 | 12/2012 |

OTHER PUBLICATIONS

Product details for the "Exer Desk," available at https://exer-desk.com/product/ (last accessed Oct. 27, 2022).
International Preliminary Report on Patentability for International Patent Application No. PCT/CA2021/050617 dated Sep. 16, 2022 (7 pages).
International Search Report and Written Opinion for International Patent No. PCT/CA2021/050617 dated Jul. 12, 2021 (8 pages).

* cited by examiner

DYNAMIC WORKSTATION APPARATUS, METHODS, AND SYSTEMS

CROSS-REFERENCE TO RELATED APPLICATIONS

This application is a § 371 National Stage Entry of International Patent Application No. PCT/CA2021/050617, filed May 3, 2021, claiming the benefit of priority of U.S. Provisional Patent Application No. 63/050,613, filed Jul. 10, 2020, and U.S. Provisional Patent Application No. 63/019,873, filed May 4, 2020, the entireties of which are hereby incorporated by reference into this application.

BACKGROUND

Technical Field

This disclosure relates generally to multi-use equipment and furniture. Particular aspects are described in relation to dynamic workstation apparatus, methods, and systems comprising an adjustable work surface height and related technologies for facilitating and monitoring body position changes.

Description of Related Art

Some existing workstations permit adjustment of a work surface height, allowing a user to change the position of their body between sitting and standing during the workday. Changes of body position and movement are known to be healthier for muscles, joints, and circulation, in contrast with the detrimental health effects of sitting or standing in fixed positions. Various types of fitness equipment that allow users to hang their body weight by their hands, thereby promoting health, especially shoulder health.

These existing workstations may permit a limited set of adjustments between fixed seated and standing positions, but do not permit adjustments which would allow full squat or seated on the floor positions. Squatting and floor seated positions further engage the range of motion of the user's toes, feet, ankles, knees, hips, and back.

Fitness equipment, especially equipment required to suspend the body by the hands, ordinarily is located separately from the workstation, limiting the changes in body position an office worker may experience during the day. Those office workers who use fitness equipment usually must do so only once per day, whether prior to work, over the lunch break, or after work, limiting their opportunities for frequent and varied body position changes, as well as flexibility and strength conditioning exercises.

SUMMARY

Aspects of dynamic workstation apparatus, methods, and systems are disclosed.

In one embodiment there is provided an apparatus including a frame including overhead frame elements defining a covered workspace, a raisable and lowerable work surface that may be configured to be movably attached to the overhead frame elements and may be selectively positionable in the covered workspace at a plurality of different vertical heights including a standing height and a floor height, and a first actuator that may be attached to and operable with the frame to move the raisable and lowerable work surface between a range of movement including the standing height and the floor height while maintaining an orientation of the raisable and lowerable work surface relative to the frame such that the raisable and lowerable work surface may remain relatively level. The first actuator may include at least one linear actuator. The at least one linear actuator may include ball screws. The at least one linear actuator may include lead screws. The different work surface heights may include a standing position. The raisable and lowerable work surface may be moved toward the overhead frame elements, and a squat position. The raisable and lowerable work surface may be adjacent a floor.

The first actuator may be electronically operable to move the raisable and lowerable work surface. The first actuator may move the raisable and lowerable work surface in response to one or more of a switch, a timer, and a sensor. The first actuator may include an electric motor mounted to the frame, further including a power source for the electric motor. The first actuator may include a linear actuator operable with an input torque applied by the electric motor. The linear actuator may include a threaded rod operably engaged with the electric motor and a receiving bolt operably engaged with the threaded rod and the raisable and lowerable work surface; and rotation of the threaded rod by the electric motor may cause generally vertical movements of the receiving bolt and the raisable and lowerable work surface between the plurality of different work surface heights. The first actuator may be controlled by a programmable controller. The programmable controller may be configurable by software running on a mobile device.

The frame may further include an equipment support. The equipment support may be configured to be positionable in the workspace at different heights. The apparatus may further include a second actuator operable to move the equipment support between the different heights. The overhead frame elements may be configured to support the equipment support at different heights. The equipment support may include structures operable to receive and retain an elongated exercise bar. The equipment support may be affixed to the frame. The equipment support may be generally vertically supported by the overhead frame elements and may be positionable in the workspace at different heights, and the frame may further include a second actuator operable to move the equipment support between the different heights. The second actuator may include at least one second linear actuator. The at least one second linear actuator may be located in a channel, and may include a threaded rod, and a receiving bolt. The equipment support may be attached to the receiving bolt through an opening in the channel.

The at least one second linear actuator may include ball screws. The at least one second linear actuator may include lead screws. The different equipment support heights may include a standing position. The equipment support may be moved toward the overhead frame elements, and a squat position. The equipment support may be adjacent a floor. The second actuator may be electronically operable to move the equipment support. The second actuator may move the equipment support in response to one or more of a switch, a timer, and a sensor. The second actuator may include an electric motor mounted to the frame and may further include a power source for the electric motor. The second actuator may include a linear actuator operable with an input torque applied by the electric motor. The linear actuator may include a threaded rod operably engaged with the electric motor and a receiving bolt operably engaged with the threaded rod and the equipment support, and rotation of the threaded rod by the electric motor may cause generally vertical movements of the receiving bolt and the equipment support between the plurality of different equipment support heights. The second actuator may be controlled by a programmable controller. The programmable controller may be configurable by software running on a mobile device. The first actuator and the second actuator may be controlled by a single programmable controller.

The first actuator may be mounted to the frame and the raisable and lowerable work surface so as to vibrationally dampen the raisable and lowerable work surface from an impact force applied to the equipment support. The apparatus may further include one or more of a display, a speaker, a sensor, and an environment modulator that may be mounted to the frame and may be powered by a power source. The frame may be permanently fixable to the floor. The frame may further include wheels to allow movement of the frame on the floor.

In another embodiment there is provided a computer-implemented method. The method involves communicating with a controller on the apparatus. Communicating involves requesting an actuator status from the controller, displaying the actuator status on a mobile device display, receiving user input for an intended actuator position, sending a command to the controller, waiting for the controller to complete processing the command, and requesting a second actuator status from the controller. Requesting the second actuator status from the controller may verify the controller successfully processed the command. Sending a command to the controller may further involve receiving an estimated wait time from the controller, and the waiting for the controller to complete processing the command may utilize the estimated wait time. The requesting a second actuator status from the controller may involve waiting for the controller to send a signal indicating the controller successfully processed the command.

In another embodiment there is provided a system for configuring a workstation. The system includes an apparatus as described above, a mobile device, and a mobile application that may implement any one of methods described above. The mobile application may be configured to interact with the controller on the apparatus to modify the configuration of the apparatus. The mobile device may be connected to the apparatus using a wireless technology. The wireless technology may be Bluetooth, or IEEE 802.11. The mobile application may utilize the time of day to determine a desired configuration of the apparatus. The mobile application may utilize data stored on the controller to determine a desired configuration of the apparatus. The mobile application may utilize health or fitness information about the user to determine a desired configuration of the apparatus.

Related apparatus, methods, and systems also are disclosed, each possible combination and variation thereof being part of this disclosure.

BRIEF DESCRIPTION OF THE DRAWINGS

The accompanying drawings, which are incorporated in and constitute part of this disclosure, illustrate exemplary aspects that, together with the written descriptions, serve to explain the principles of this disclosure. Numerous aspects are shown conceptually in the drawings and particularly described, pointed out, and taught in the written descriptions. Some structural and operational aspects may be better understood by referencing the written portions together with the accompanying drawings, of which.

Figure 1:
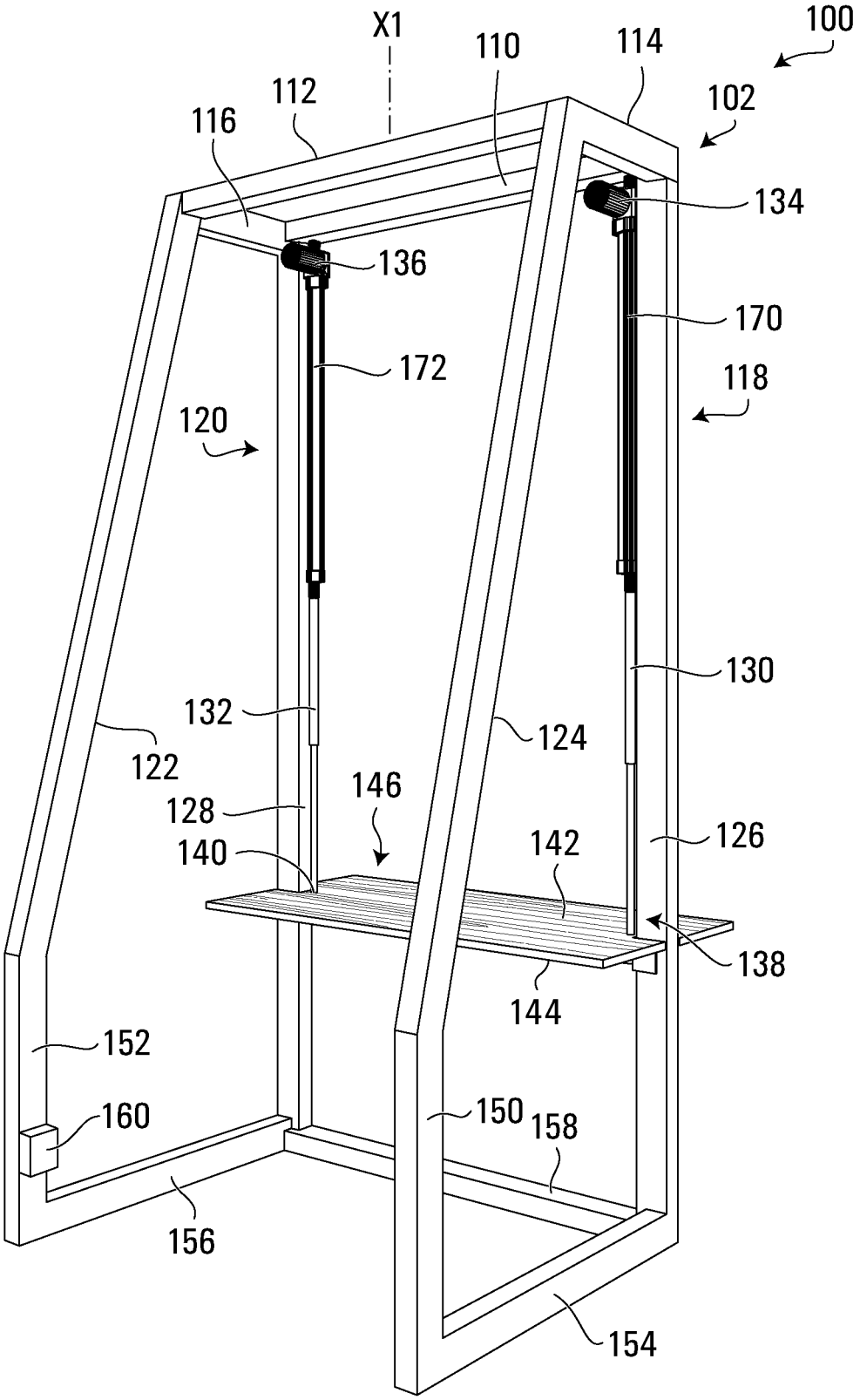
FIG. 1 depicts a perspective view of an exemplary dynamic workstation.

Aspects of the examples illustrated in the drawings may be explained further by way of citations to the drawing and element numbers in the text of the description. The drawings, element numbers, and any references thereto are provided for illustration purposes, and to further clarify the description of the present disclosure and are not intended to limit the present disclosure unless claimed.

DETAILED DESCRIPTION

Aspects of the present disclosure are not limited to the exemplary structural details and component arrangements described in this description and shown in the accompanying drawings. Many aspects of this disclosure may be applicable to other aspects and/or capable of being practiced or carried out in various variants of use, including the examples described herein.

Throughout the written descriptions, specific details are set forth to provide a more thorough understanding to persons of ordinary skill in the art. For convenience and ease of description, some well-known elements may be described conceptually to avoid unnecessarily obscuring the focus of this disclosure. In this regard, the written descriptions and accompanying drawings should be interpreted as illustrative rather than restrictive, enabling rather than limiting.

Exemplary aspects of this disclosure reference dynamic workstation apparatus, methods, and systems are disclosed. Some aspects are described with reference to particular elements (e.g., a work surface) moveable relative to other elements (e.g., a frame) utilizing particular mechanisms (e.g., an actuator) operable to cause particular movements (e.g., moving the work surface vertically relative to the frame) with particular movement characteristics (e.g., between a standing position and a floor position). Unless claimed, these descriptions are provided for convenience and not intended to limit this disclosure. Accordingly, any aspects described in this disclosure with reference to these particular examples may be similarly utilized with any comparable apparatus, methods, and systems.

Several exemplary reference axes are described, including a lateral axis X-X, a longitudinal axis Y-Y, and a vertical axis Z-Z. Some elements and/or movements thereof are described relative to these axes, such as a first or upward movement direction D1 and a second or downward movement path D2. For example, lateral axis X-X and longitudinal axis Y-Y may define a horizontal working plane, and various elements may be movable along or about vertical axis Z-Z in directions toward and away from the plane. As a further example, some objects may be described as "elongated," meaning that they have a length greater than a width along a reference axis. Additional movements and forces are similarly described. These relative terms are provided for convenience and do not limit this disclosure unless claimed.

Inclusive terms such as "comprises," "comprising," "includes," "including," and variations thereof, are intended to cover a non-exclusive inclusion, such that any described apparatus, method, system, or element thereof comprising a list of elements does not include only those elements, but may include other elements not expressly listed and/or inherent thereto. Unless stated otherwise, the term "exemplary" is used in the sense of "example," rather than "ideal." Various terms of approximation may be used, including "approximately" and "generally." Approximately means "roughly" or within 10% of a stated number or outcome and generally means "usually" or more than a 50% probability.

Terms such as "attached to," "attachable to," and "attaching" are intended to generically describe a structural connection between two or more elements. Some structural connections may be "fixedly attached" and thus non-rotatable, as when the two or more elements are formed together and cannot be rotated independently without damage. Other structural connections may be "movably attached," as when the two or more elements are coupled together by attachment elements adapted to permit relative movements of those elements (e.g., rotating, sliding, telescoping). Unless stated otherwise, the generic term "attach" and its equivalents may comprise any such variations.

Aspects of any exemplary computing device are described. Functional terms such as "processing," "computing," "calculating," "determining," "displaying," and the like, may refer to actions and processes performable by the computing, which may comprise any type of software and/or hardware. The software of the computing device may comprise program objects (e.g., lines of codes) executable to perform various functions. Each program object may comprise a sequence of operations leading to a desired result, such as an algorithm. The operations may require or involve physical manipulations of physical quantities, such as electrical or magnetic signals capable of being stored, transferred, combined, compared, and otherwise manipulated. The signals may be described conceptually as bits, characters, elements, numbers, symbols, terms, values, or the like.

The hardware of the computing device may comprise any known computing and/or networking devices that are specially or generally adapted to execute the program objects, perform the operations, and/or send or receive the signals. Any known hardware devices may be described conceptually. For example, the hardware may comprise a processing unit adapted to execute the project objects by manipulating and/or transforming input data represented as physical (electronic) quantities within the unit's registers and memories into output data similarly represented as physical quantities within the unit's memories or registers and/or other data storage, transmission, or display devices. The processing unit may comprise any number of processor(s) and/or processing element(s), including any singular or plural computing resources disposed local to or remote from one another.

The hardware of the computing device also may comprise any known technologies for storing the program objects and any data associated therewith. For example, the program objects may be stored in any machine (e.g. computer) readable storage medium in communication with the processing unit, including any mechanism for storing or transmitting data and information in a form readable by a machine (e.g., a computer). Exemplary storage mediums may comprise: read only memory ("ROM"); random access memory ("RAM"); erasable programmable ROMs ("EPROMs"); electrically erasable programmable ROMs ("EEPROMs"); magnetic or optical cards or disks; flash memory devices; and/or any electrical, optical, acoustical or other form of propagated signals (e.g., carrier waves, infrared signals, digital signals, etc.).

In keeping with above, the computing device may comprise a smartphone or similar device, such as iPhone or other iOS device, an Android phone or other Android device, or any comparable and/or compatible devices operable as the computing device described herein.

Some aspects of the present disclosure are described with reference to methods, steps of which may be performable with the computing device. To help orient the reader, some methods are described with reference to a conceptual drawing, such as a flowchart with boxes interconnected by arrows. Each box may represent a particular step or technology. The boxes may be combined, interconnected, and/or interchangeable to provide options for additional modifications according to this disclosure. The arrows may define an exemplary sequence of operation for the steps, the order of which may be important. For example, a particular order of the steps may describe a sequence of operation that is performable by the computing element to realize specific processing benefits, such as improving a computational performance and/or an operational efficiency. Aspects of this disclosure are now described with reference to exemplary workstation structure 100. As shown in FIG. 1, for example, workstation structure 100 may comprise a work surface that is adjustable between an extended range of positions including a first position at a standing height, a second position at a seated height, and a third position at floor level. Workstation structure 100 may comprise overhead elements that are positioned to enable various types of fitness enhancing activities, such as hanging by the hands. Workstation structure 100 also may comprise a monitoring system that is operable to monitor a user's activity and prompt the user to complete a fitness and/or rehabilitative program.

As shown in FIG. 1, for example, workstation structure 100 may comprise a frame 102, a work surface 146, a controller 160, and at least one actuator 171.

As shown in FIG. 1, frame 102 may comprise overhead frame elements defining a covered workspace. Frame 102 may comprise multiple vertical frame elements such as front vertical frame posts 122 and 124, front frame posts 150 and 152, and rear vertical frame posts 118 and 120. Front vertical frame posts 122 and 124, and rear vertical frame posts 118 and 120 may extend from the floor of the frame 102 to the top of the frame 102 where the overhead frame elements are present. These frame posts may be made of any metal, wood, and/or plastic material operable as structural elements to bear the weight of the apparatus and any weights supported thereby, including the weight of a user. Front vertical frame posts 122 and 124, and rear vertical frame posts 118 and 120 may comprise any combination of round tubing, may comprise square tubing, and/or solid posts. The overhead fame elements may comprise a front top bar 112, a rear top bar 110, a left top bar 116, and a right top bar 114. These overhead frame elements may similarly comprise any metal, wood, and/or plastic materials attachable to posts 118, 120, 122, and 124 to form a rigid moment frame structure that does not deflect under the weight(s) applied thereto, resists any twisting motions caused by dynamic elements of the weight(s), and provides structural rigidity for the apparatus. The overhead elements may comprise square tubing, round tubing, and/or solid posts.

Work surface 146 may be made of any rigid material that resists bending and provides a suitable surface for locating work materials and performing desk-based work. As shown in FIG. 1, work surface 146 may comprise a rectangular shape defining a worksurface top 142 and a worksurface bottom 144. Work surface 146 may be manufactured from any type of lightweight structural material, including any combination of wood, metal, ceramic, stone, plexiglass, and/or glass. The shape and size of work surface 146 may be variable and customizable to accommodate any working environment.

Controller 160 may comprise any electronic components operable to communicate and process data, including any components located proximate to and/or remote from workstation 100. For example, controller 160 may be an Arduino™ Uno or Raspberry Pi 4 or similar type computing device. The controller 160 may be expandable by adding further computing hardware such as networking adapters, or other controller components such as motors or sensors that assist in the operation of controller 160.

Figure 21:
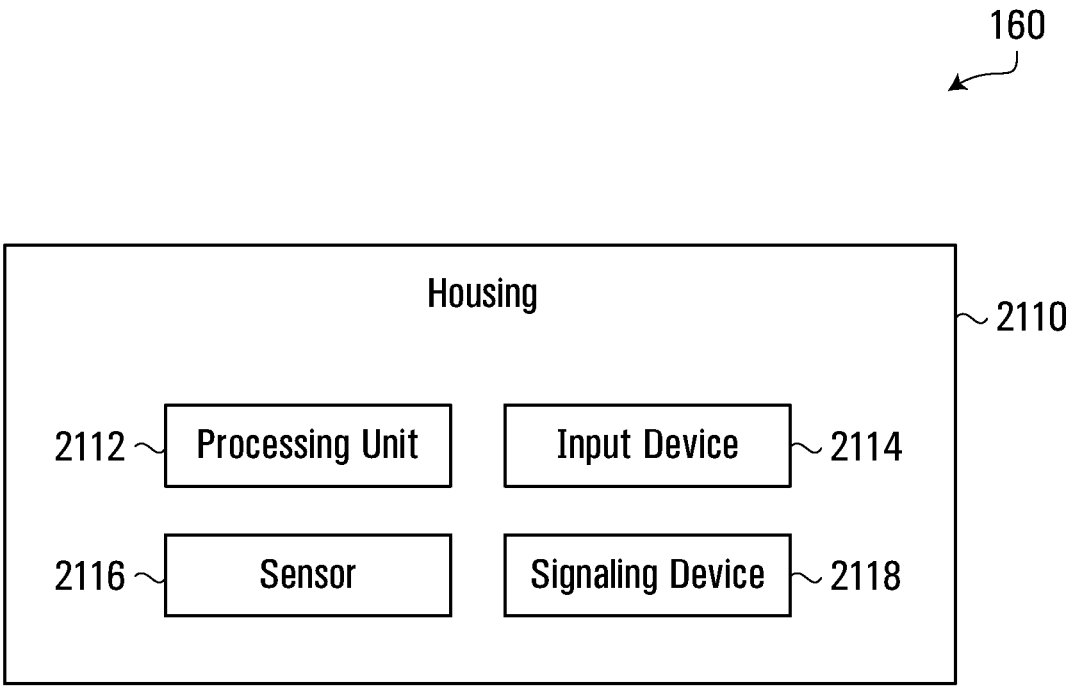
FIG. 21 depicts a representation of a controller for use with the FIG. 10 workstation.

As shown in FIG. 21, for example, controller 160 may comprise a housing 2110, a processing unit 2112, input device 2114, a sensor 2116, and a signalling device 2118.

Housing 2110 may comprise a moisture-resistant container attachable to frame 102, including any type of metal and/or plastic box. As shown in FIG. 21, for example, processing unit 2112 may be mounted in housing 2110 and elements of input device 2114, sensor 2116, and/or signalling device 2118 may be mounted to housing 2110 or frame 102 and in electronic communication with processing unit 2112. To accommodate different types of data communication, housing 2110 may comprise a polymeric material adapted to pass the electronic signals with wires and/or wirelessly therethrough.

As shown in in FIG. 21, processing unit 2112 may receive data from input device 2114 and/or sensor 2116 over a network, generate control signals with program objects based on the received data, and output the control signals to other elements of workstation 100 over the network. The computing technologies may comprise any combination of one or more processors, a memory, and a transceiver, a communication bus, and a power source. Elements of the processor(s), memory, transceiver, and/or communication bus may be local to and/or remote from processing unit 2112. The transceiver and the communication bus may comprise data communication technologies operable to send and/or receive data over the network, including wired and/or wireless data communication technologies operable with any type of wired and/or wireless network. The wireless network may be an IEEE 802.11 network or a Bluetooth network.

Input device 2114 may comprise any known data input device, including any combination of buttons, cameras, microphones, screens, switches, and like interface technologies. As shown in FIG. 1, for example, input device 2114 may comprise a switch located on front vertical frame post 124.

Sensor 2116 may comprise one or more sensors in data communication with processing unit 2112 over the network. As shown in FIGS. 1 and 21, for example, sensor 2116 may comprise a linear distance sensor 2020, and/or a contact force sensor 2022. Each of these sensors may be positioned about workstation 100, in data communication with processing unit 2112, and operable to with other elements of workstation 100 to allow for operation of work surface 146. As shown in FIG. 1, for example, linear distance sensor 2020 may comprise a distance sensor that is located in front vertical frame posts 122 and 124, and operable to output data to processor 2112 for determining the vertical height of work surface 146. As shown in FIG. 1, for example, contact force sensor 2022 may comprise an voltage sensor that is located on a an actuator motor and operable to output data to processor 2112 for determining when the work surface 146 makes contact with objects and/or users, and/or measuring a force associated that contact.

As shown in FIG. 1, for example, the at least one actuator 171 may comprise actuators 170 and 172. Actuators 170 and 172 may comprise actuator bodies 134 and 136, threaded rods 130 and 132, and receiving bolts 126 and 128. Actuator bodies 134 and 136 may comprise an electric motor that may be operable to rotate a screw or a gear. Actuator bodies 134 and 136 may also comprise a rotary electric drive motor. Actuator bodies 134 and 136 also have a receptacle or opening that is designed to receive the upper end of a threaded rod. Threaded rods 130 and 132 may be inclined planes wrapped helically around an axis, such that rotating the rod around its axis may allow a force to be applied normal to the surface of the inclined plane, similar to a screw. Threaded rods 130 and 132 may be of equal length to provide for similar actuation distances to allow work surface 146 to be raised and lowered equally on both sides of workstation 100. Threaded rods 130 and 132 may be enclosed in a casing or a sheath as shown in FIG. 1, to prevent damage to the threaded rods, and to prevent ingress of unwanted materials into the threads, as well as protecting the user during operation. Receiving bolts 126 and 128 comprise a bolt that is affixed to the works surface 146 by actuator connections 138 and 140. Receiving Bolts 126 and 128 may comprise a cylindrical bolt that is threaded on the interior of the bolt cavity, so that receiving bolts 126 and 128 may be able to engage with threaded rods 130 and 132. Receiving bolts 126 and 128 may be longer than threaded rods 130 and 132 and may be able to fully contain threaded rods 130 and 132. Ideally, receiving bolts 126 and 128 may be the same length as threaded rods 130 and 132, to provide the maximum linear actuation distance, as if the threaded rods 130 and 132 are longer than the receiving bolts 126 and 128, then the receiving bolts 126 and 128 may not be able to fully engage the threaded rods 130 and 132. Likewise, if the receiving bolts 126 and 128 are longer than the threaded rods 130 and 132, then a portion of the receiving bolts may not be engageable by the threaded rods 130 and 132 leading to a decrease in possible linear actuation distance.

Actuators 170 and 172 as shown in FIG. 1, may comprise "Hall Effect Sensor Linear Actuators" such as provided by Progressive Automations™. Actuators 170 and 172 may be pre-assembled as a single replaceable unit or may comprise separate components that are provided by different manufacturers.

As shown in FIG. 1, for example, the actuators 170 and 172 may attach to the work surface top 142 by actuator connections 138 and 140. These actuator connections 138 and 140 may comprise metal or plastic operable to support the weight of the work surface 146.

Exemplary methods of manufacturing workstation 100 are now described with ongoing reference to the drawings.

As shown in FIG. 1, for example, the elements of frame 102 may be attached to define a rigid moment frame structure that is self-supporting on the ground and configured to resist deflections and/or vibrations caused by moving work surface 146. The overhead vertical components may be rigidly attached to define a rectangular cross-section of the rigid moment frame structure. As shown in FIG. 1, for example, the moment frame overhead vertical components may comprise a front top bar 112, rear top bar 110, left top bar 116, and right top bar 114, all may be attached perpendicularly to form the rectangular top beam of the moment frame. The moment frame may also comprise front vertical frame posts 122 and 124 and rear vertical frame posts 118 and 120 which may act as columns. All the vertical frame posts may be parallel. Front vertical frame posts 122 and 124 may be angled depending on the length of front frame posts 150 and 152. Front frame posts 150 and 152 may be small and inline with front vertical frame posts 122 and 124, forming an extension of front vertical frame posts 122 and 124, allowing them to be vertical.

As shown in FIG. 1, actuator bodies 134 and 136 may be fixedly connected to right top bar 114 and left top bar 116. Actuator bodies 134 and 136 may be attached to right top bar 114 and left top bar 116 using bolts, screws, or by more rigid methods of fixation, such as welding or using adhesives. Actuator bodies 134 and 136 have threaded rods 130 and 132 may be threaded or rotatably engaged into the receiving hole at the bottom of actuator bodies 134 and 136. The threaded rods may be threaded or rotatably engaged into the receiving hole at the top of receiving bolts 126 and 128. The actuator bodies 134 and 136 engage, hold, and support threaded rods 130 and 132. Threaded rods 130 and 132 engage and support receiving bolts 126 and 128. Threaded rods 130 and 132 are not rigidly connected to actuator bodies 134 and 136 or receiving bolts 126 and 128, but are engaged via the threads on threaded rods 130 and 132, and the corresponding threads on the inside of actuator bodies 134 and 136, and the threads inside receiving bolts 126 and 128. This allows threaded rods 130 and 132 to couple and support work surface 146 from top right bar 114 and top left bar 116. Because the threads on threaded rods 130 and 132 engage actuator bodies 134 and 136 and receiving bolts 126 and 128, if screws 130 and 132 do not move, then they securely support and prevent linear motion of work surface 146 along axis X1.

As shown in FIG. 1, work surface 146 may be attached to actuators 170 and 172 by work surface actuator connections 138 and 140. These connections may be fixed or may allow rotation of work surface 146. Actuator 172 may be connected to left top bar 116. Actuator 170 may be connected to right top bar 114. The actuators 170 and 172 may form an extensible connection from the work surface 146 to the overhead components of frame 102. Work surface 146 may be kept level by the operation of actuators 170 and 172. In various embodiments, level may mean generally horizontal, or parallel to an axis. The level of the work surface 146 may be generally parallel to the floor, or may be set to another fixed axis, such as to counteract a non-level floor.

Controller 160 may be attached to any elements of frame 102 but is shown in FIG. 1 in an exemplary position as attached to vertical frame post 118. Controller 160 may be electrically connected to actuators 170 and 172 using electrical conductors such as wire, such that the actuators 170 and 172 may be able to receive electrical signals sent by controller 160. Controller 160 also may be connected to actuators 170 and 172 by a computer network using network interfaces to send and receive signals as previously disclosed such that controller 160 may send control signals to actuators 170 and 172 over this network.

Actuators 170 and 172 may have power provided by electrical wiring that is connected to supply mains. Actuators 170 and 172 may use electricity provided over the supply mains to operate the motors contained therein.

Operational aspects of workstation 100 are now described with ongoing reference to the drawings.

Once the components of workstation 100 are manufactured in keeping with this disclosure, work surface 146 may be vertically supported by the overhead frame elements and positionable in the workspace at different work surface heights. As shown in FIG. 1, for example, controller 160 may be operable to cause work surface 146 to be raised and lowered vertically along the X1 axis using actuators 170 and 172 by rotation of threaded rods 130 and 132. For example, controller 160 may be operable to send control signals to actuator bodies 134 and 136, starting their operation, actuator bodies 134 and 136 may commence operation of the motors contained inside.

Controller 160 may comprise a levelling sequence whereby the controller sends control signals to actuators 170 and 172 in order to keep the work surface 146 level. This may be accomplished by sending signals to both actuators 170 and 172 at the same time, which would cause actuators 170 and 172 to operate simultaneously. Controller 160 may also send control signals to one actuator at a time, to step the actuator in the desired linear direction. The controller 160 may alternate sending control signals to each of actuators 170 and 172 to reduce the strain on work surface 142 while each of the actuators steps out of sync of the other.

As shown in FIGS. 1 and 21, the program objects may comprise lines of code executable with processing unit 2112 to control certain functions of workstation 100. In keeping with above, for example, one program object may comprise lines of code that are executable with processor unit 2112 to: receive data from input device 2114 and/or sensor 2116; output the first control signals to actuator 170 when the received data indicates that work surface 146 is not at the desired height; and stop outputting the first control signals when the received data indicates that that work surface 146 is at the desired height.

When activated, input device 2114 may output notification signals to processing unit 2112 causing output of the first control signals to actuator 170, which in turn may cause threaded rod 130 to rotate in a first rotational direction RD1. Input device 2114 may comprise location-based controls. For example, if input device 2114 comprises a mobile computing device (e.g., like a smartphone), then it may comprise a program object (e.g., part of an application) that prevents a user from operating input device 2114 when location data associated with the mobile computing device (e.g., GPS signals) indicates that the user is not proximate to workstation 100.

As shown in FIG. 1, When the motors inside actuators 170 and 172 operate, they may engage with threaded rods 130 and 132 via the threaded rods 130 and 132, to apply a rotating force to the threaded rods 130 and 132, causing threaded rods 130 and 132 to rotate about their linear axis. When threaded rods 130 and 132 are rotating about their linear axis, they may engage and exert a rotational force to the receiving bolts 126 and 128 through the threads on the inside of the bolt. When receiving bolts 126 and 128 are engaged by threaded rods 130 and 132, they may experience a force in the direction of the rotational axis. This force results in the receiving bolts 126 and 128 moving in the linear actuation direction, parallel with axis X1. When threaded rods 130 and 132 turn clockwise, the receiving bolts 126 and 128 may move in one direction parallel with axis X1, and when threaded rods 130 and 132 turn counter clockwise, the receiving bolts 126 and 128 may move in the other direction parallel with axis X1.

Work surface 146 may be lowerable completely to the floor. As actuator bodies 134 and 136 rotate threaded rods 130 and 132, they may move the work surface actuator connections 138 and 140 closer to, or further away from left top bar 116 and right top bar 114. Controller 160 may send control signals to actuators 170 and 172 for causing level raising and lowering of work surface 146. For example, controller 160 may cause actuators 170 and 172 to work in tandem (e.g., at approximately the same time and speed) to allow work surface 146 to remain level during raising or lowering. Workstation 100 may further comprise a manual switch to control the actuators and may allow the user to manually raise or lower the work surface 146.

The user may desire a vertical position when using the device entirely for fitness training as it may provide more space for body movement. Users may find various tilt angles of the work surface 146 preferable, similar to those commonly found on drafting tables, to be more comfortable when performing certain work tasks.

Preferably, the adjustable height of work surface 146 may permit a user to work in a standing position, various heights of seated positions, and in various heights of a squatting positions as well as sitting directly on the floor. In a preferred embodiment, the height of the work surface 146 may be adjusted electronically and programmed to various height positions on the X1 axis and programmed to move to various height positions according to set timers. Other behaviors of changing positions may be accomplished by programming the controller 160 to operate the actuators 170 and 172 in response to different criteria. A manually adjustable work surface is also within the scope of this disclosure.

Actuators 170 and 172 as shown in FIG. 1, may further comprise any combination of electrical pulleys, worm drive style actuators, lead screws, and/or ball screw type actuators operable to move work surface 146 relative to frame 102.

Figure 27:
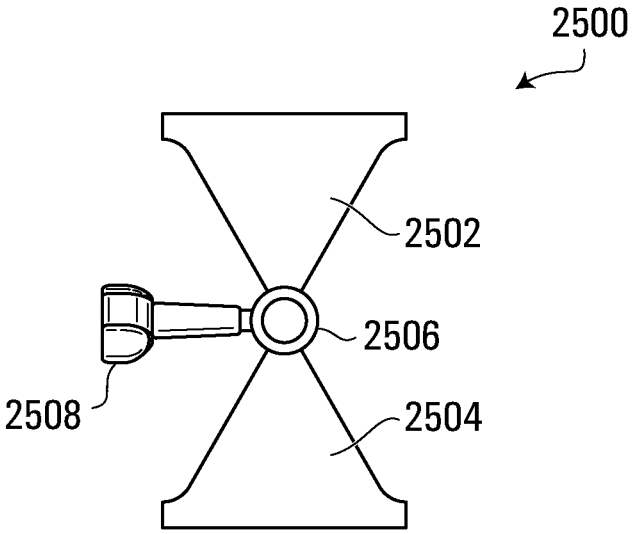
FIG. 27 depicts a hinge connection for use with the FIG. 10 workstation.

Work surface 146 may further comprise as shown in FIG. 27, connections 138 and 140. These connections may comprise a hinged connector, comprising hinge 2500, first hinge plate 2502, and second hinge plate 2504. As shown in FIG. 27, for example, first hinge plate 2502 may be secured to second hinge plate 2504 by hinge 2500. Hinge 2500 may allow for first hinge plate 2502 to rotate away from second hinge plate 2504 about the hinge 2500 as an axis. Since connections 138 and 140 may comprise hinges, work surface 146 may be tilted for ease of use. if work surface actuator connections 138 and 140 are configured to allow for tilting functionality. One embodiment may have the work surface 146 made to tilt to any angle from horizontal to vertical about hinge 2500.

Put another way, as described herein and shown in FIG. 1, workstation 100 may comprise a frame 102 comprising overhead frame elements defining a covered workspace, a raisable and lowerable work surface 146 that may be configured to be movably attached to the overhead frame elements and selectively positionable in the covered workspace at a plurality of different vertical heights including a standing height and a floor height, and a first actuator that is attached to and operable with the frame 102 to move the raisable and lowerable work surface 146 between a range of movement including the standing height and the floor height while maintaining an orientation of the raisable and lowerable work surface 146 relative to the frame 102 such that the raisable and lowerable work surface 146 remains relatively level. The actuator in workstation 100 may further comprise at least one linear actuator. The at least one linear actuator in workstation 100 may comprise ball screws, lead screws, or other mechanical linear actuators. The raisable and lowerable work surface 146 heights of workstation 100 may comprise a standing position wherein the raisable and lowerable work surface 146 is moved toward the overhead frame elements and a squat position wherein the raisable and lowerable work surface 146 is adjacent a floor. The first actuator in workstation 100 may be electronically operable to move the raisable and lowerable work surface 146. The first actuator in workstation 100 may move the raisable and lowerable work surface 146 in response to one or more of a switch, a timer, and a sensor. The first actuator in workstation 100 may comprise an electric motor mounted to the frame 102 and may further comprise a power source for the electric motor. The first actuator in workstation 100 may comprise a linear actuator operable with an input torque applied by the electric motor. Workstation 100 may be configured where the linear actuator comprises a threaded rod 130 operably engaged with the electric motor and a receiving bolt 126 operably engaged with the threaded rod 130 and the raisable and lowerable work surface 146, and rotation of the threaded rod 130 by the electric motor causes generally vertical movements of the receiving bolt 126 and the raisable and lowerable work surface 146 between the plurality of different work surface 146 heights. The first actuator in workstation 100 may be controlled by a programmable controller 160.

Figure 23:
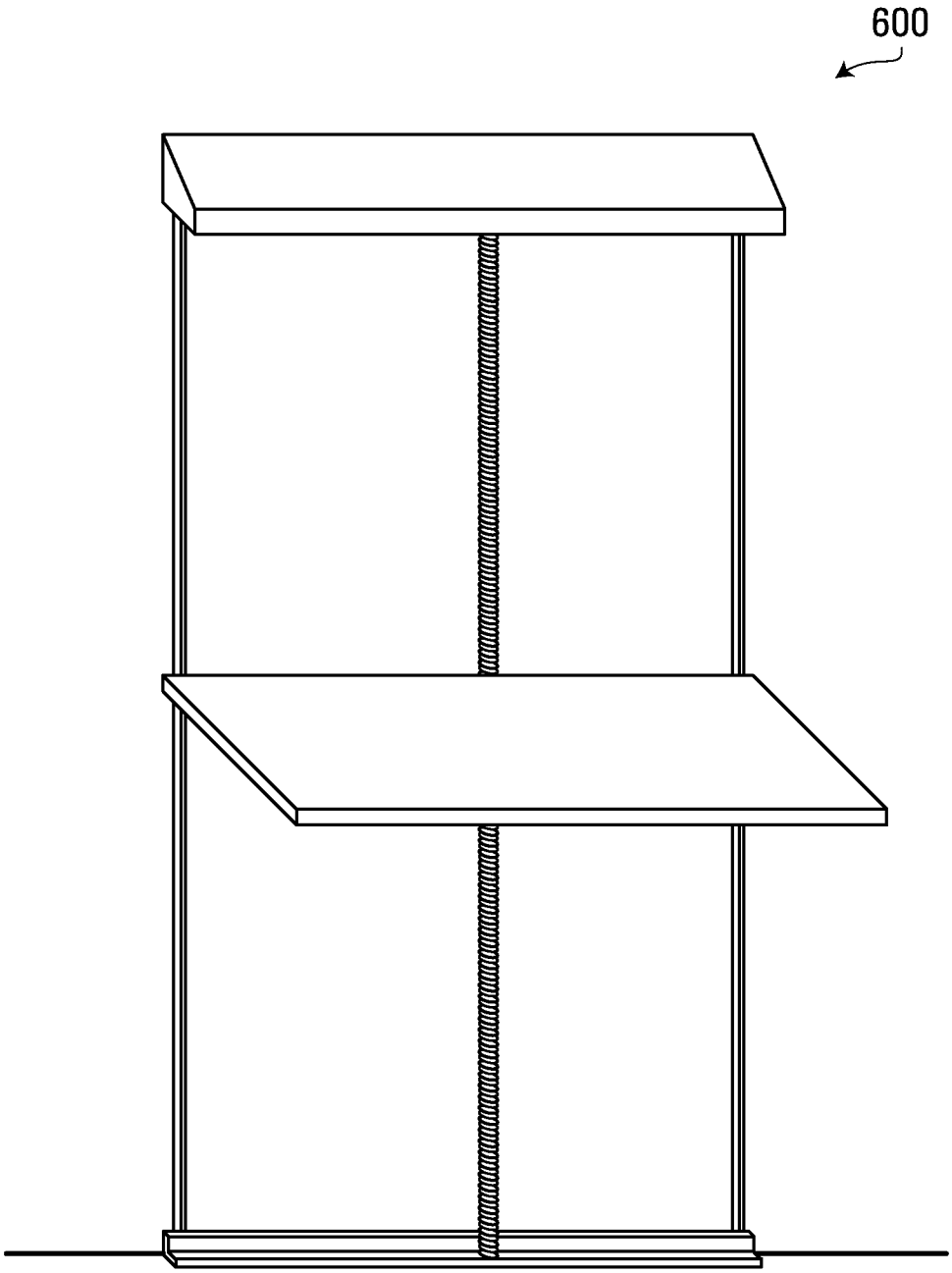
FIG. 23 is a perspective view of another exemplary of the dynamic workstation that is wall mounted.
Figure 24:
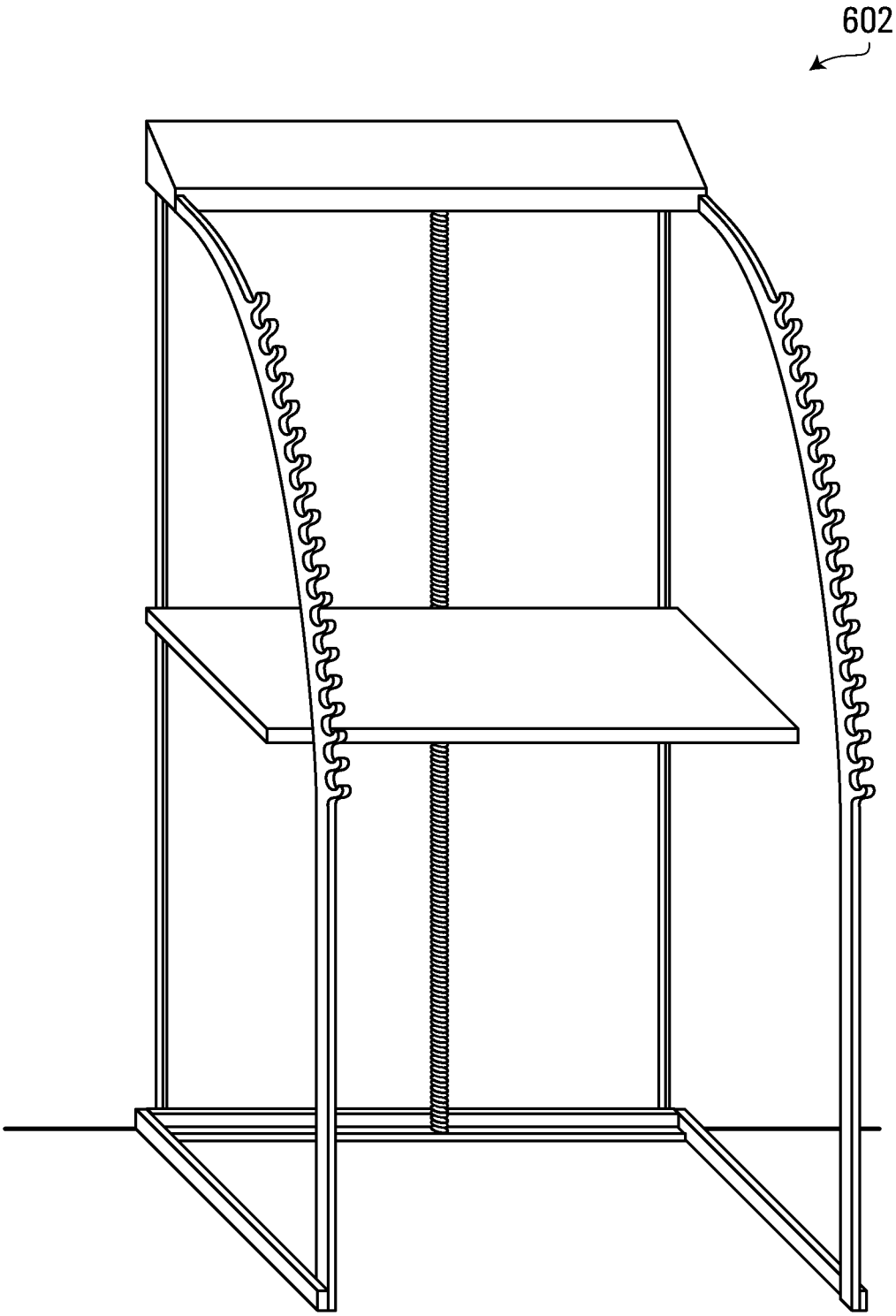
FIG. 24 is a perspective view of another exemplary of the dynamic workstation that is wall mounted, with exercise bar suspension rails.

Additional aspects of this disclosure are now described with reference to an exemplary workstation structure 200 shown in FIGS. 2 to 9; an exemplary workstation 300 shown in FIGS. 10 to 20; an exemplary workstations 600 shown in FIG. 23; and an exemplary workstation 602 shown in FIG. 24. Each of the embodiments shown in FIGS. 2 to 20 may show additional or alternative components for workstation 100. Any aspects described with reference any workstation structure 100, 200, 300, 600, and/or 602 may be used interchangeably, with each possible combination and iteration being part of this disclosure. Each of workstation 100, 200, 300, 600, and 602 may be described with reference to a different series of numbers and have corresponding elements.

As shown in FIGS. 2 to 9, for example, workstation 200 may have a modified frame that can accept an exercise bar in a multitude of positions.

Figure 2:
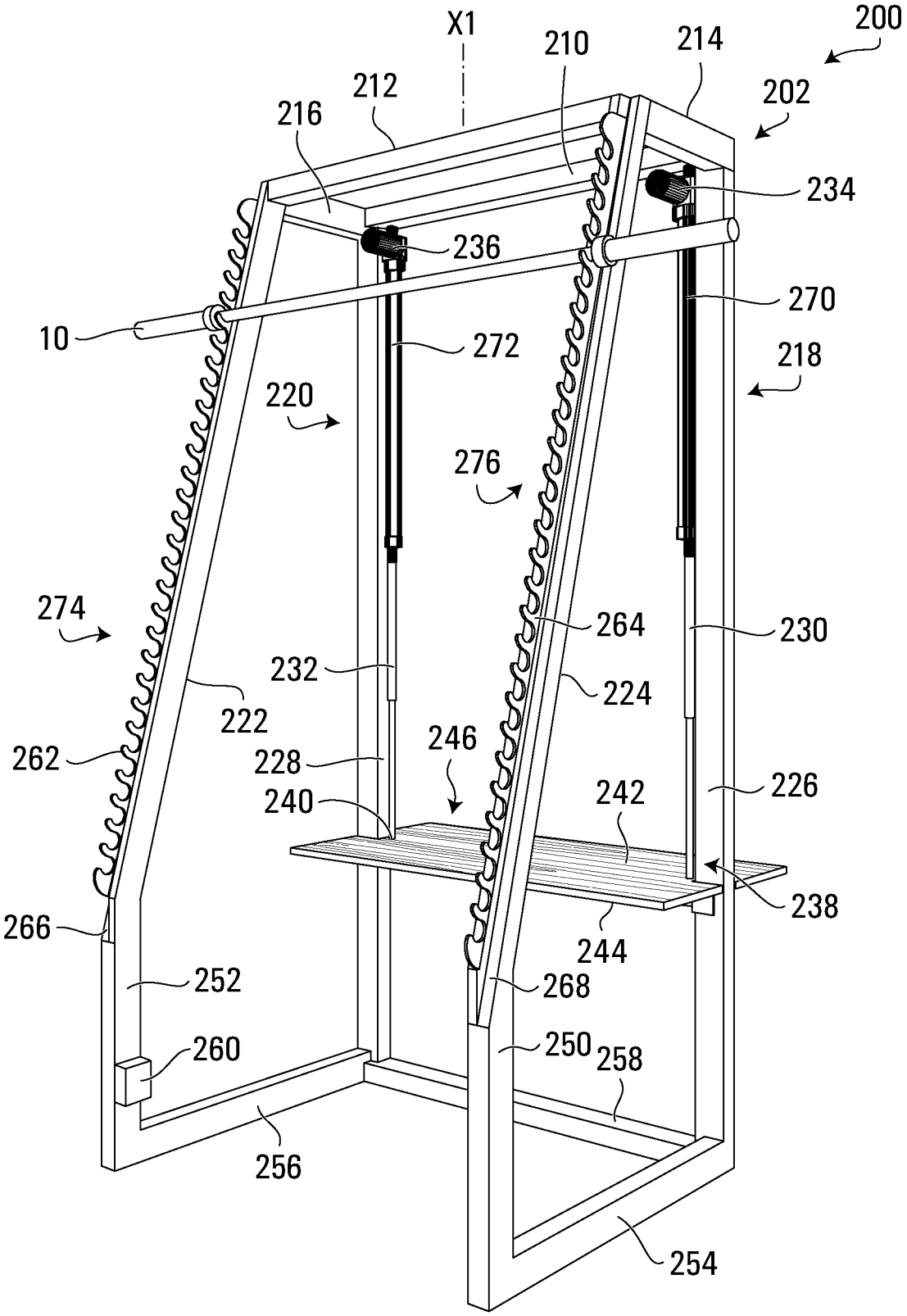
FIG. 2 is a perspective view of an exemplary dynamic workstation with bar suspension rails.

As shown in FIG. 2, for example, workstation structure 200—much like workstation 100, may comprise a work surface that is adjustable between an extended, floor-to-ceiling range of positions including a first position at a standing height or higher, a second position at a seated height, and a third position at floor level.

As shown in FIGS. 2 to 9, for example, workstation structure 200 may comprise a frame 202, a work surface 246, actuators 270 and 272, and a controller 260.

Similar to frame 102, frame 202 also may comprise overhead frame elements defining a covered workspace. The elements of frame 202 may be made of any metal, wood, and/or plastic elements operable to form a moment frame structure configured to bear the weight of and provide structural rigidity for workstation apparatus 200. As shown in FIG. 2, frame 202 may comprise multiple vertical frame elements such as front angled frame posts 222 and 224, and rear vertical frame posts 218 and 220. Frame 202 also may comprise front vertical frame posts 250 and 252. The overhead frame elements may comprise a front top bar 212, a rear top bar 210, a left top bar 216, and a right top bar 214. Frame 202 also may comprise left bottom bar 256, right bottom bar 254 and rear bottom bar 258.

Figure 5:
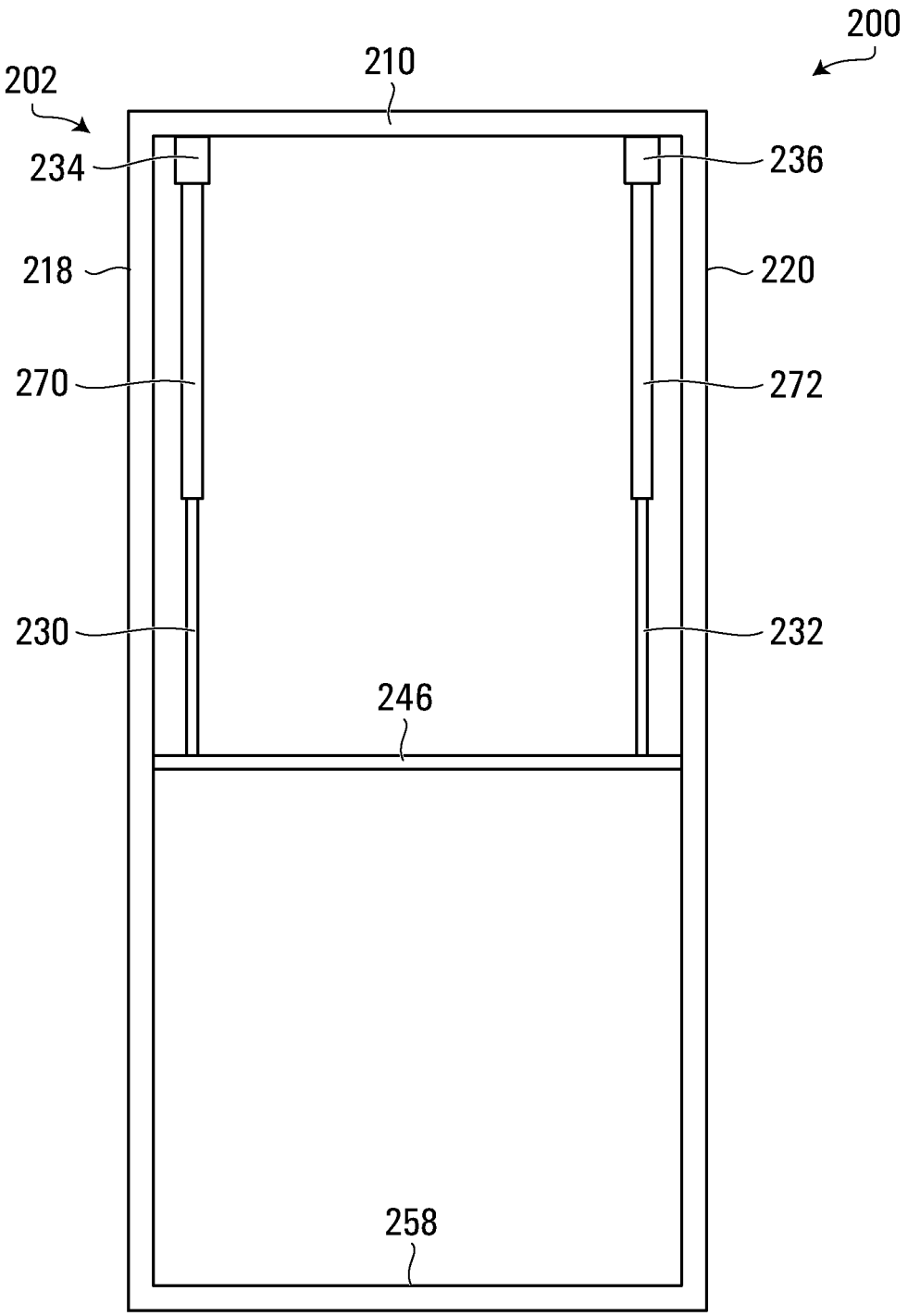
FIG. 5 depicts another elevation and plan view of the FIG. 2 workstation.
Figure 6:
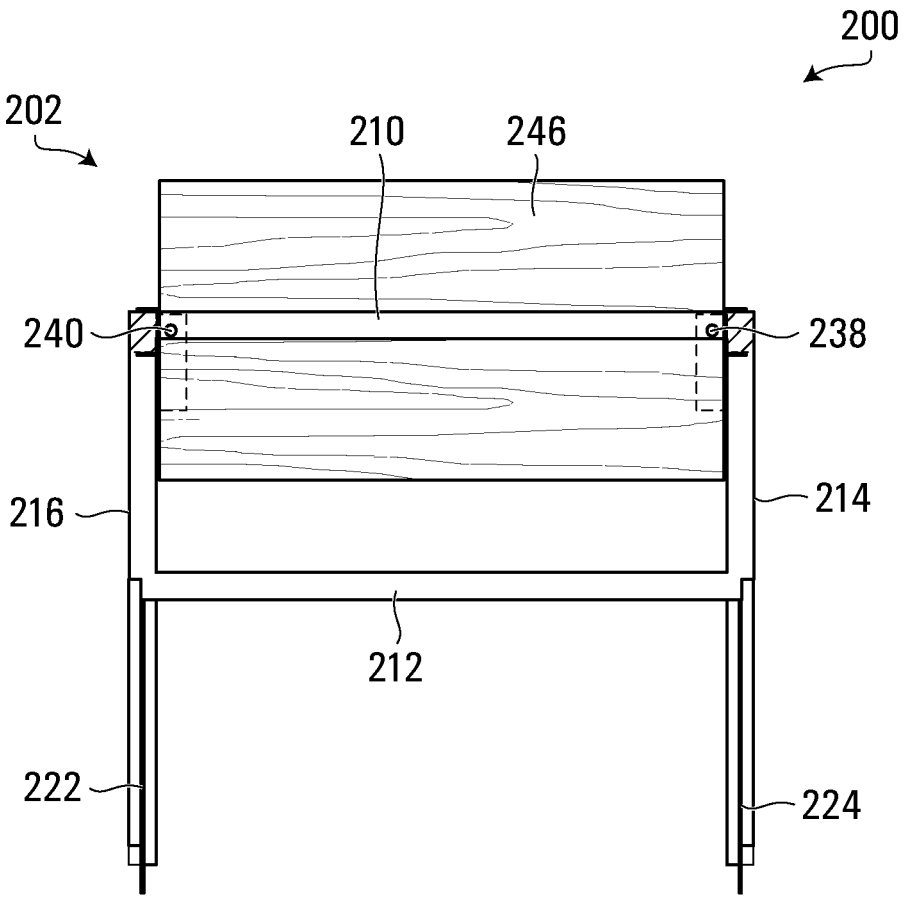
FIG. 6 depicts an overhead elevation and plan view of the FIG. 2 workstation.

Frame 202 also may comprise exercise bar recesses 266 and 268 that run the length of front angled frame posts 222 and 224 respectively as shown in FIG. 5. Frame 202 also may comprise bar suspension rails 274 and 276. Bar suspension rails 274 and 276 may comprise serrations 262 and 264 respectively.

Work surface 246 may be similar to work surface 146, and may further comprise a worksurface top 242, and a worksurface bottom 244 as shown in FIG. 2. One embodiment of the work surface 246 may be made of any rigid material that will resist bending and provide a suitable work surface. The work surface 246 size can be variable and customizable. The work surface 246 also As shown in FIG. 2, actuators 270 and 272 may be similar to actuators 170 and 172 and may comprise "Hall Effect Sensor Linear Actuators" such as provided by Progressive Automations™.

Controller 260 may be similar to controller 160, and may comprise a computing device, or a generic microcontroller capable of controlling actuators 270 and 272 and maintaining level operation of work surface 246. For example, controller 260 may be an Arduino™ Uno as described above.

Methods of manufacturing structure 200 are now described.

As shown in FIG. 2, for example, frame 202 may be assembled in a pentagonal prism shape. The overhead vertical components may be rigidly attached in a rectangular shape. Front top bar 212 may be perpendicularly attached to left top bar 216 and right top bar 214, and rear top bar 210 may be also perpendicularly attached to left top bar 216 and right top bar 214. This may create a rectangular shape where front top bar 212 may be parallel to rear top bar 210 and may be perpendicular to left top bar 216 and right top bar 214. The front frame post 222 may be rigidly attached to both left top bar 216 and front top bar 212. The front frame post 224 may be rigidly attached to both right top bar 214 and front top bar 212. The rear vertical frame post 220 may be rigidly attached perpendicular to both left top bar 216 and rear top bar 210. The rear vertical frame post 218 may be rigidly attached perpendicular to both right top bar 214 and rear top bar 210. This may result in rear vertical frame posts 218 and 220 being vertically parallel.

Figure 3:
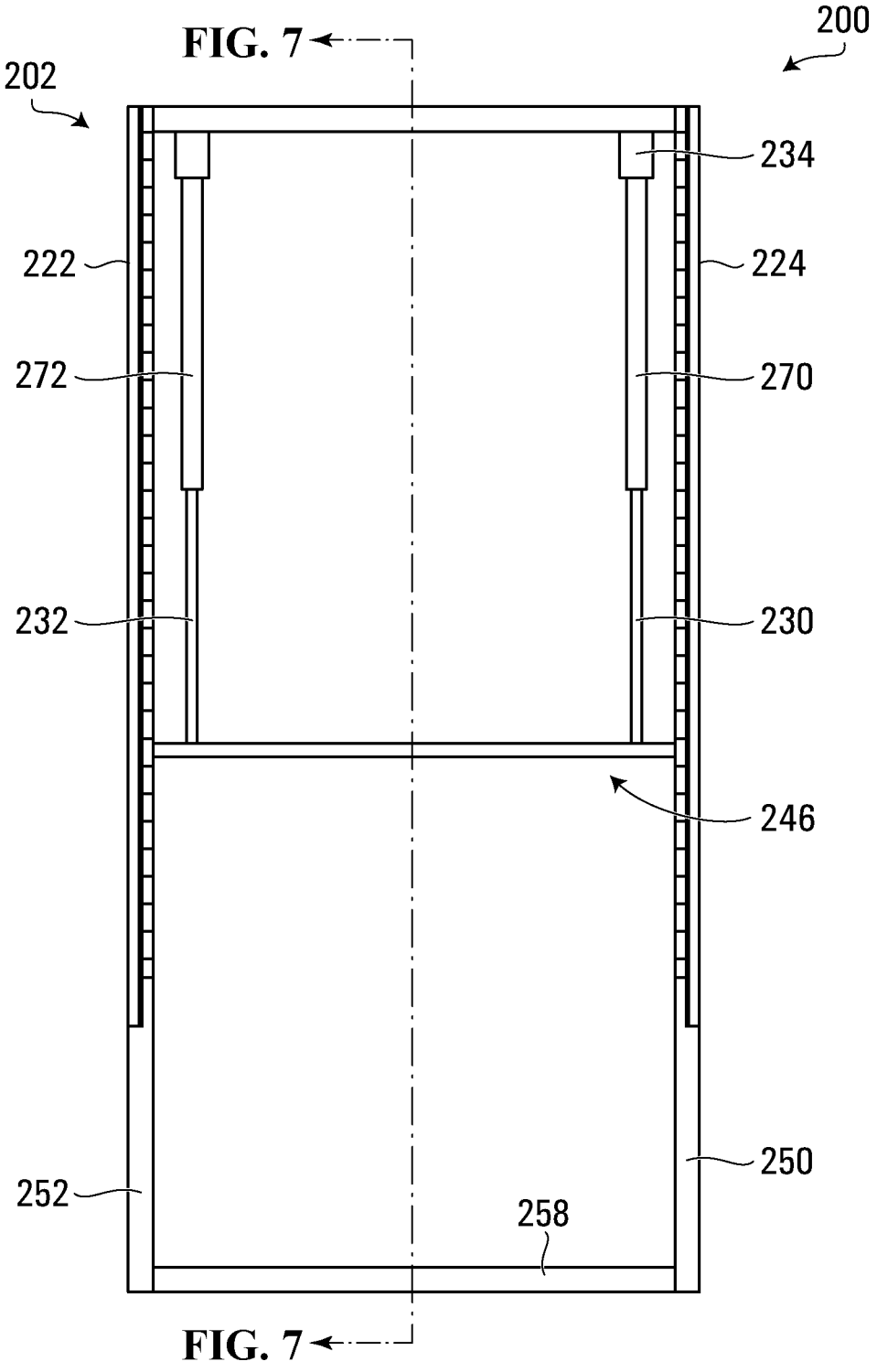
FIG. 3 depicts an elevation and plan view of the FIG. 2 workstation.

Front frame posts 222 and 224 will extend diagonally away from rear vertical frame posts 218 and 220. Front frame posts 222 may be rigidly attached to front vertical frame post 252. Front frame post 224 may be rigidly attached to front vertical frame post 250. Front vertical fame posts 250 and 252 are vertically parallel and are perpendicular to the floor. Front vertical fame post 252 may be rigidly attached perpendicularly to left bottom bar 256. Left bottom bar 256 connects the bottom of front vertical frame post 252 and rear vertical frame post 220. Rear bottom bar 258 may be perpendicularly attached to the bottom end of rear vertical frame post 220 and rear vertical frame post 218. Right bottom bar may be perpendicularly attached to the bottom end of rear vertical frame post 218 and front vertical frame post 250. Left bottom bar 256 may be perpendicular to rear bottom bar 258, and rear bottom bar 258 may be perpendicular to 254. bar suspension rails 274 and 276 are attached to the outside of front frame posts 222 and 224, such that the serrations 262 and 264 are parallel, allowing for exercise bar 10 to be able to rest securely in the serrations 262 and 264. Controller 260 may be attached to any elements of frame 202 but is shown in FIG. 3 in an exemplary position as attached to front vertical frame post 252. Controller 260 may be electrically connected to actuators 270 and 272 and may be connected to actuator bodies 234 and 236 so that the controller 260 may be able to control actuators 270 and 272.

As shown in FIG. 2, work surface 246 may be attached to actuators 270 and 272 by work surface actuator connections 238 and 240. These connections may be fixed or may allow rotation of work surface 246, similar to work surface 146. Actuator 272 may be connected to rear top bar 210. Actuator 270 also may be connected to rear top bar 210. The actuators 270 and 272 may form an extensible connection from the work surface 246 to the overhead components of frame 202.

Operational aspects of workstation 200 are now described with ongoing reference to the drawings.

As shown in FIG. 3, for example, work surface 246 may vertically supported by the overhead frame elements and positionable in the workspace at different work surface heights; and work Surface 246 may be raised and lowered vertically along the X1 axis using actuators 270 and 272 by extension or retraction of actuator arms 230 and 232. Work surface 246 may be lowerable completely to the floor. As actuator bodies 234 and 236 extend or retract actuator arms 230 and 232, they may move the work surface actuator connections 238 and 240 closer to, or further away from rear top bar 210. The two actuators must work in tandem, and at the same time and speed to allow work surface 246 to remain level during raising or lowering. Controller 260 may be similar to controller 160 and may be configured to control the operation of actuators 270 and 272 to allow for the level raising and lowering of work surface. Controller 260 may use multiple software packages to keep work surface 246 level. Controller 260 may use a software product such as the "Hall Effect" software provided by Progressive Automations™ to maintain level operation, while using a different software package to control the linear actuation of the actuators 270 and 272. Controller 260 may further comprise a manual switch to control the operation of actuators 270 and 272 to allow for the level raising and lowering of work surface 246.

Similar to work surface 146, work surface 246 may be tilted for ease of use. One embodiment may have the work surface 246 made to tilt to any angle from horizontal to vertical. The user may desire the vertical position when using the device entirely for fitness training as it would provide more space for body movement. Users may find various tilts of the work surface 246, as in that found on drafting tables, more comfortable when performing certain work tasks.

Figure 7:
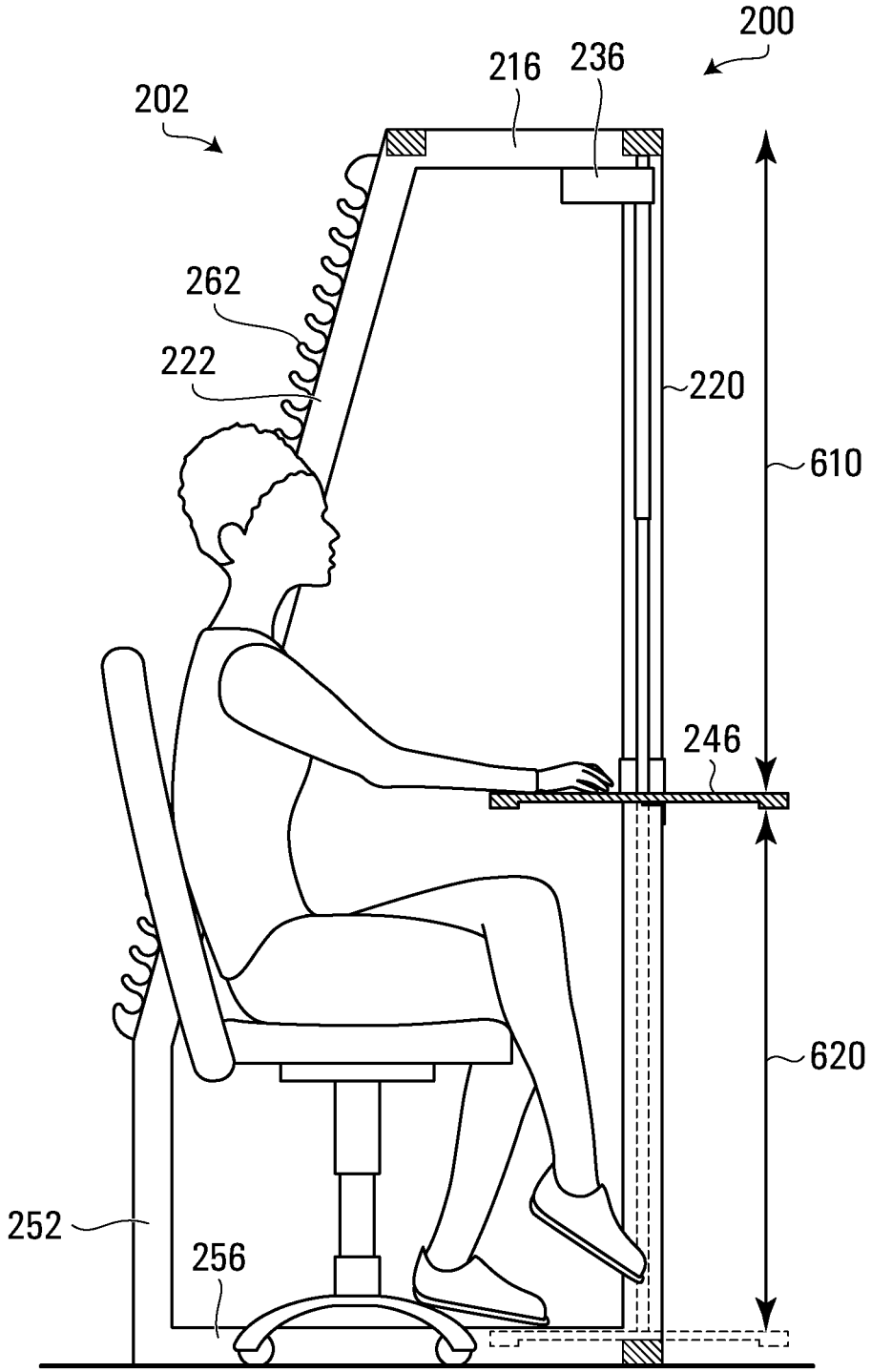
FIG. 7 depicts the sitting in a chair body position attainable by a user of the FIG. 2 workstation.
Figure 8:
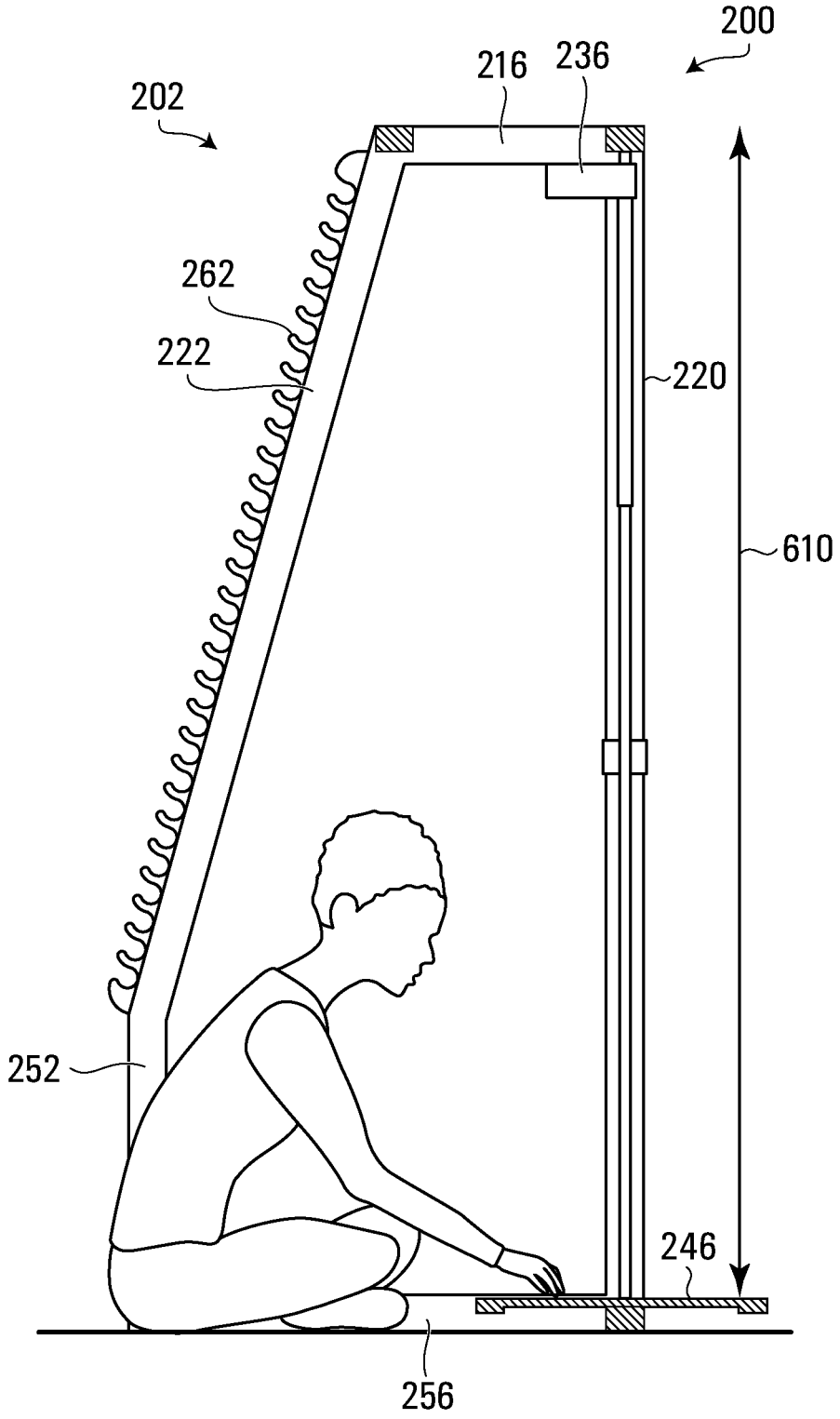
FIG. 8 depicts the sitting on the floor body position attainable by a user of the FIG. 2 workstation.
Figure 9:
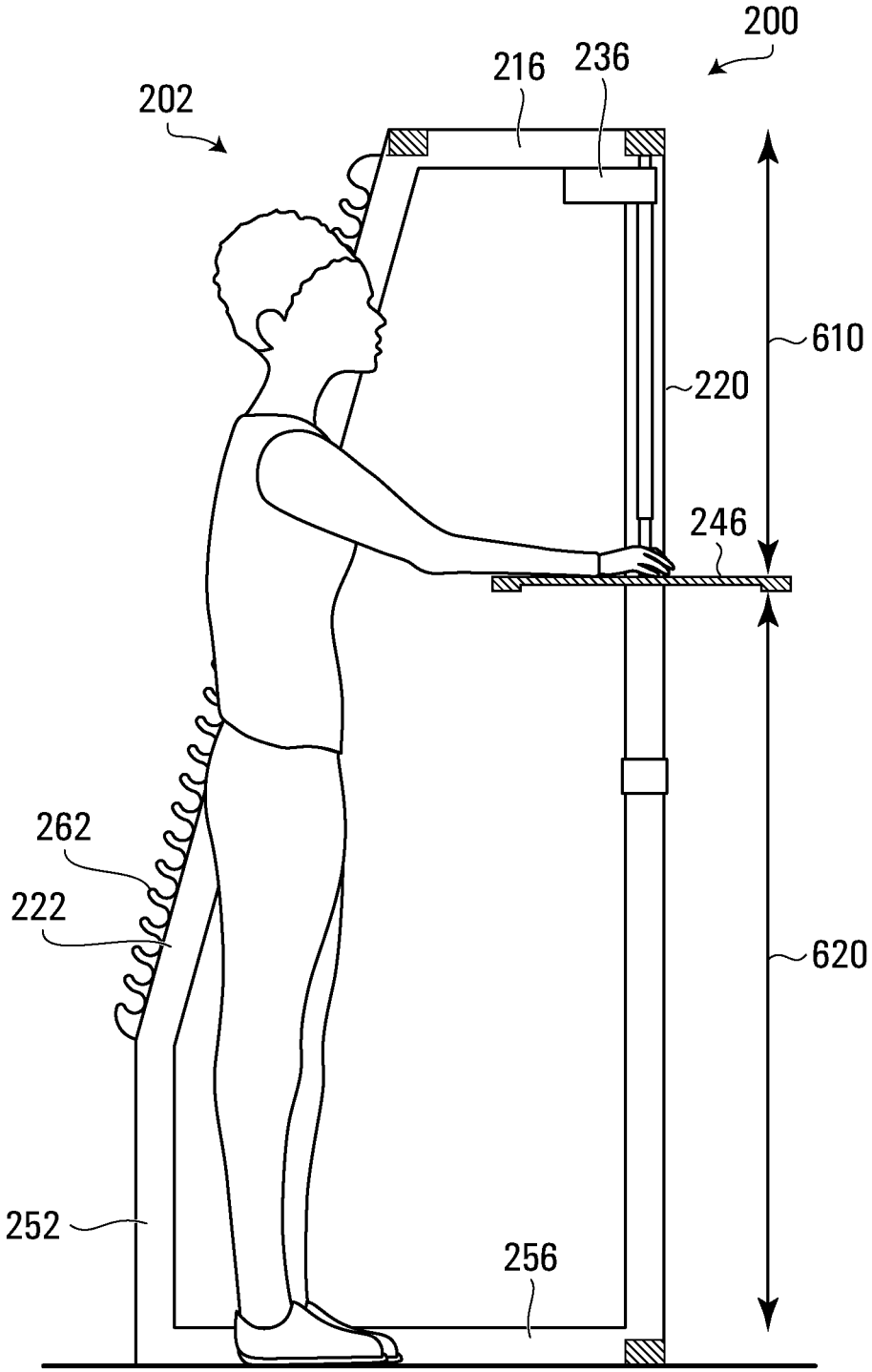
FIG. 9 depicts the standing body position attainable by a user of the FIG. 2 workstation.

Preferably, the adjustable height of work surface 246 will permit a user to work in a standing position as shown in FIG. 9, various heights of seated positions as shown in FIG. 7, and in various heights of a squatting positions as well as sitting directly on the floor as shown in FIG. 8. In a preferred embodiment, the height of the work surface 246 may be adjusted electronically and programmed to various height positions on the X1 axis and programmed to move to various height positions according to set timers. Other behaviors of changing positions may be accomplished by programming the controller 260 to operate the actuators 270 and 272 in response to different criteria. A manually adjustable work surface also may be used. Frame 202 also may provide the ability to position the exercise bar 10 high enough to suspend the body by the user's hands.

Figure 4:
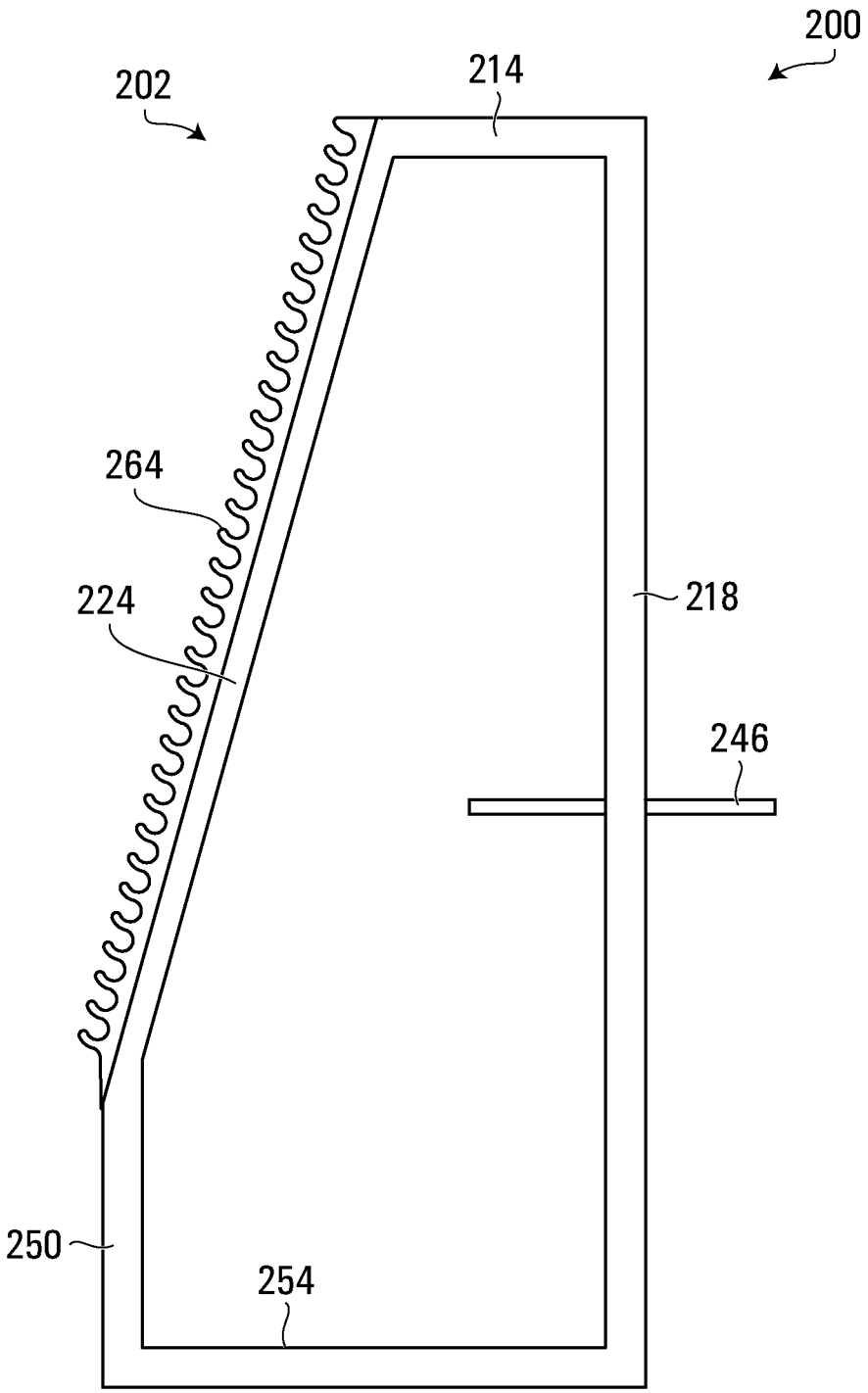
FIG. 4 depicts another elevation and plan view of the FIG. 2 workstation.

As shown in FIG. 4, for example, a height of frame 202 may be approximately 8 to 9 feet high to accommodate tall users or approximately 7 to 8 feet high to fit into premises with 8-foot ceilings. As also shown in FIG. 4, a width of front top bar 212 may be approximately 50" so that it may accommodate a 50" span between outside to outside edge of pair of bar suspension rails 274 and 276 so that a user could use exercise bar 10 for hanging and pull-ups, as well as various weight training exercises. The pair of bar suspension rails 274 and 276 also may be located on a back of frame 202.

Put another way, the programmable controller 260 may be configurable by software running on a mobile device. The frame 202 of workstation 200 may comprise an equipment support 274. The equipment support may comprise structures operable to receive and retain an elongated exercise bar 10. The equipment support may be affixed to the frame 202 of workstation 200. The first actuator in workstation 200 may be mounted to the frame 202 and the raisable and lowerable work surface 246 so as to vibrationally dampen the raisable and lowerable work surface 246 from an impact force applied to the equipment support 274. The impact force may be applied to the equipment support 274 by the elongated exercise bar 10 for example.

Aspects of this disclosure are now described with reference to exemplary workstation structure 300, however references to workstation 100 and 200 also may be included. Another embodiment of the apparatus may have a modified frame that can accept an exercise bar in a raisable bracket.

As shown in the drawings, for example, workstation structure 300 may be similar to workstation 100, and may comprise a work surface that is adjustable between an extended range of positions including a first position at a standing height, a second position at a seated height, and a third position at floor level. Workstation structure 300 may comprise overhead elements that are positioned to enable various types of fitness enhancing activities, such as hanging by the hands. Structure 300 also may comprise a monitoring system that is operable to monitor a user's activity and prompt the user to complete a fitness and/or rehabilitative program. Workstation structure 300 also may comprise bar brackets that may receive and hold an exercise bar. Workstation structure 300 also may comprise linear actuators inside the frame elements to allow for a greater range of motion.

As shown in FIGS. 10 to 18, for example, workstation structure 300 may comprise a frame 302, a work surface 346, and actuators 370, 372, 374 and 376.

Figure 10:
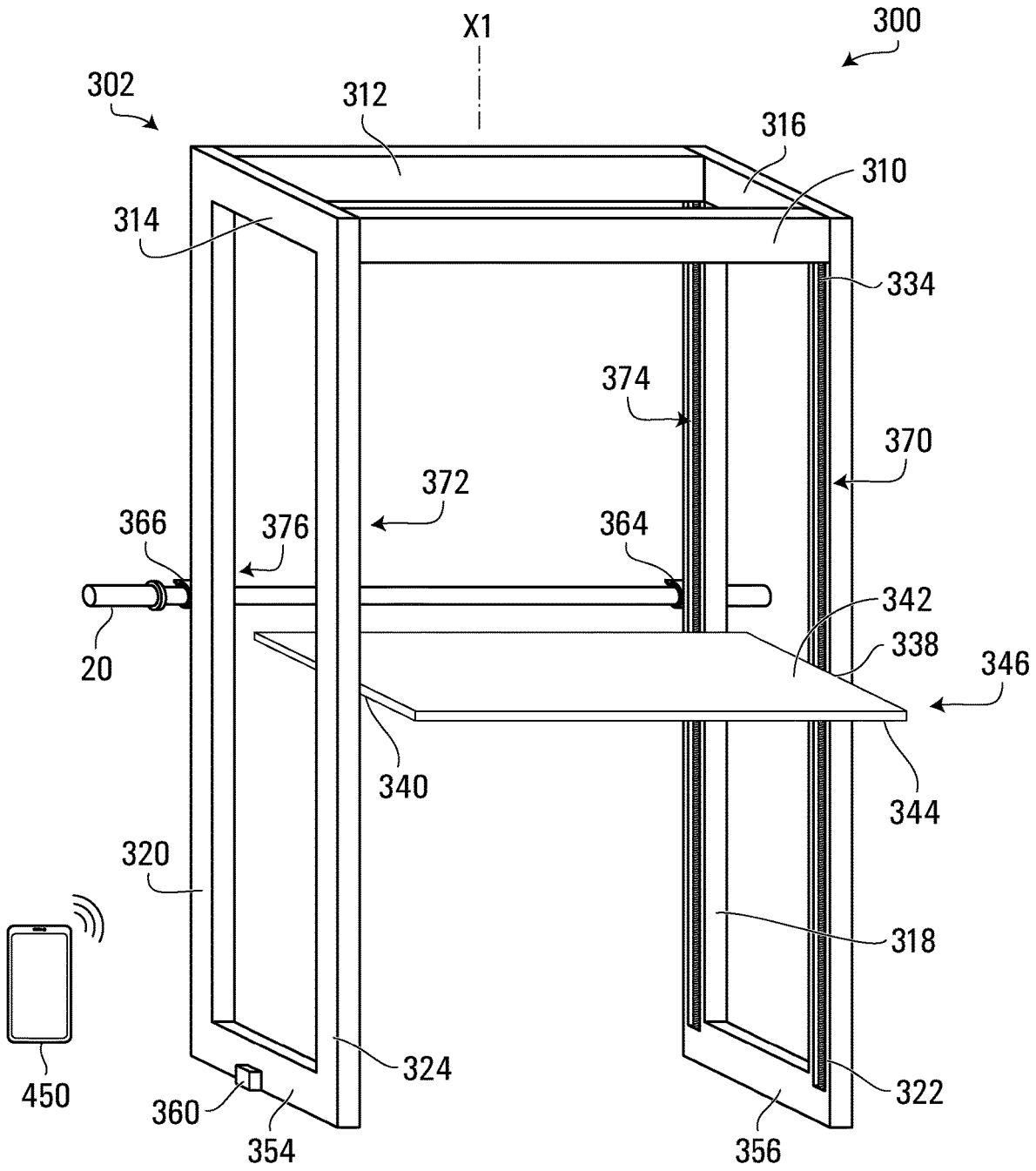
FIG. 10 is a perspective view of an exemplary dynamic workstation with moveable exercise bar holders.
Figure 11:
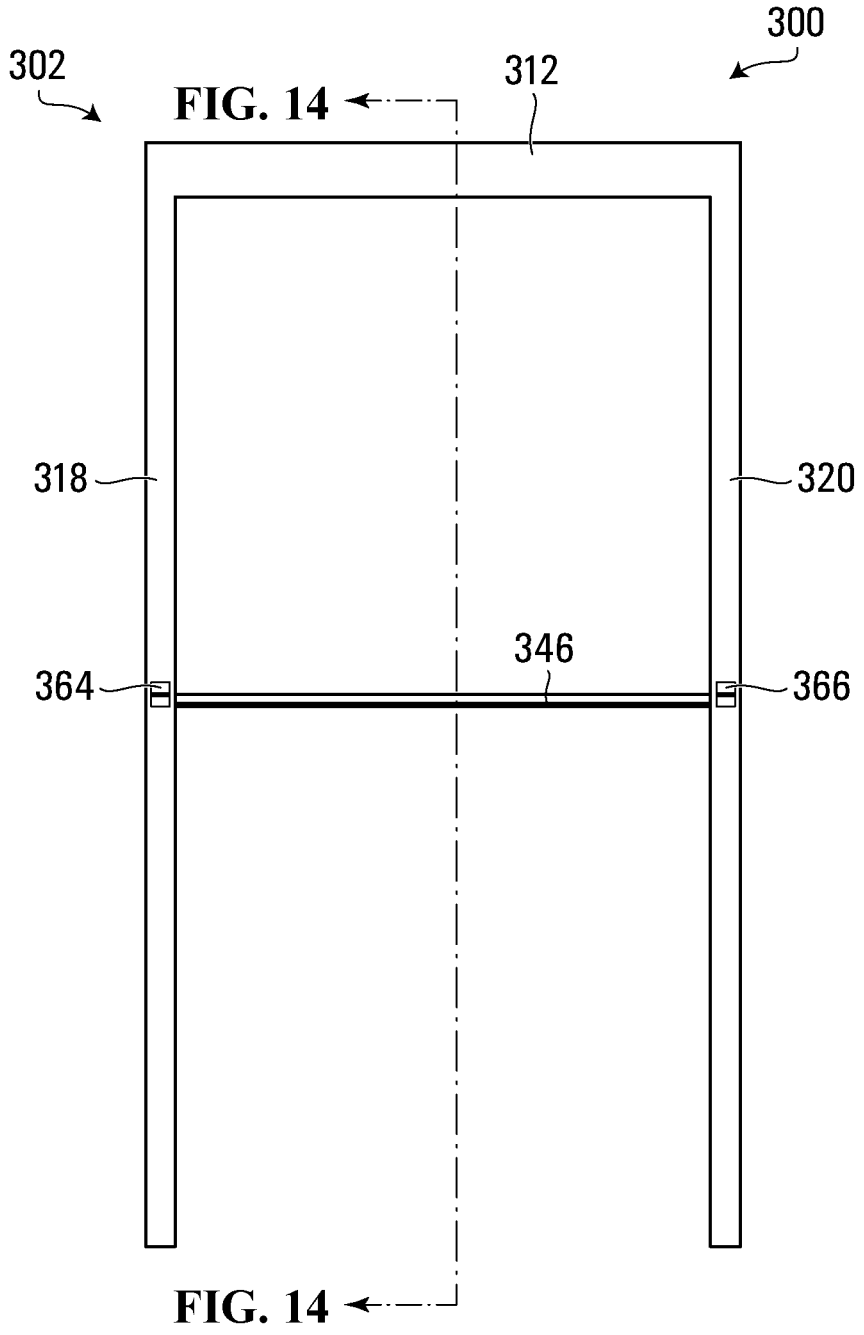
FIG. 11 depicts an elevation and plan view of the FIG. 10 workstation.
Figure 12:
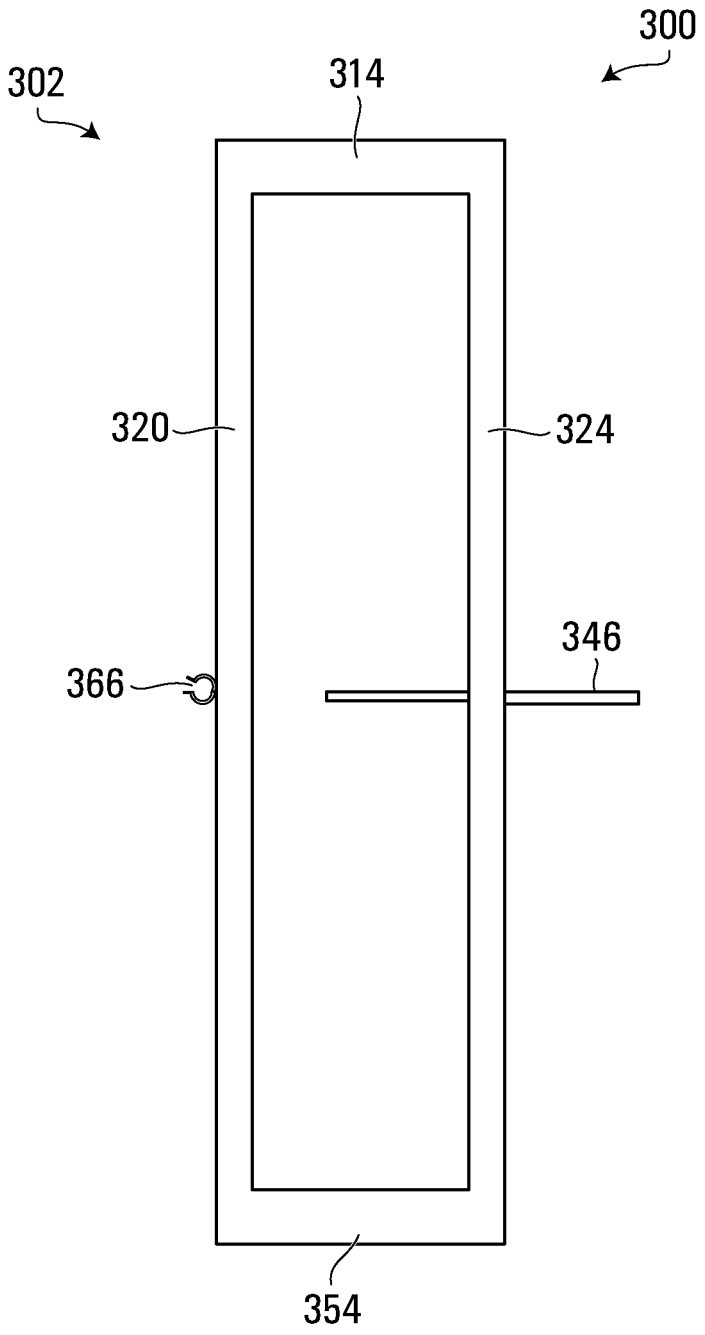
FIG. 12 depicts another elevation and plan view of the FIG. 10 workstation.
Figure 13:
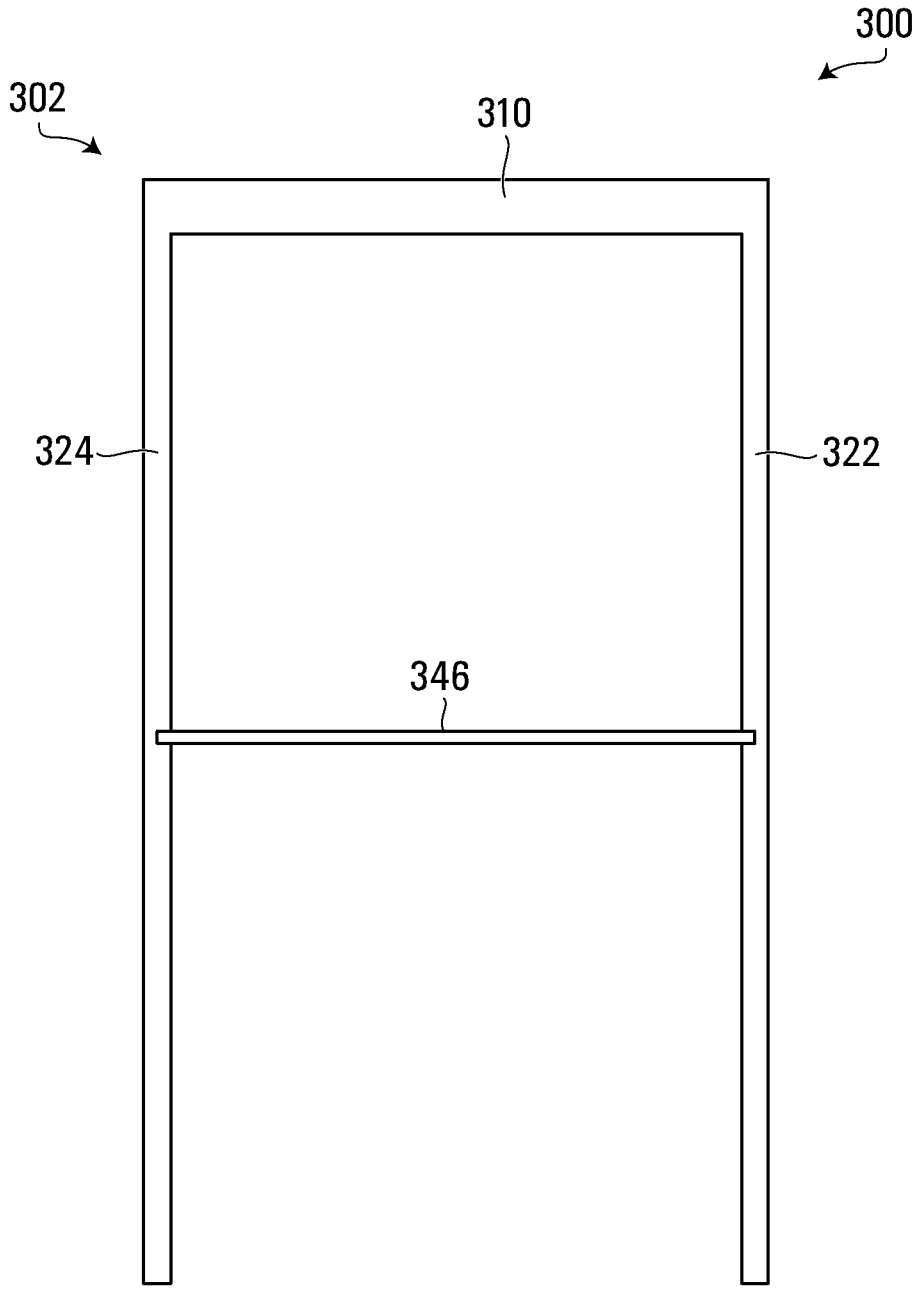
FIG. 13 depicts another elevation and plan view of the FIG. 10 workstation.
Figure 14:
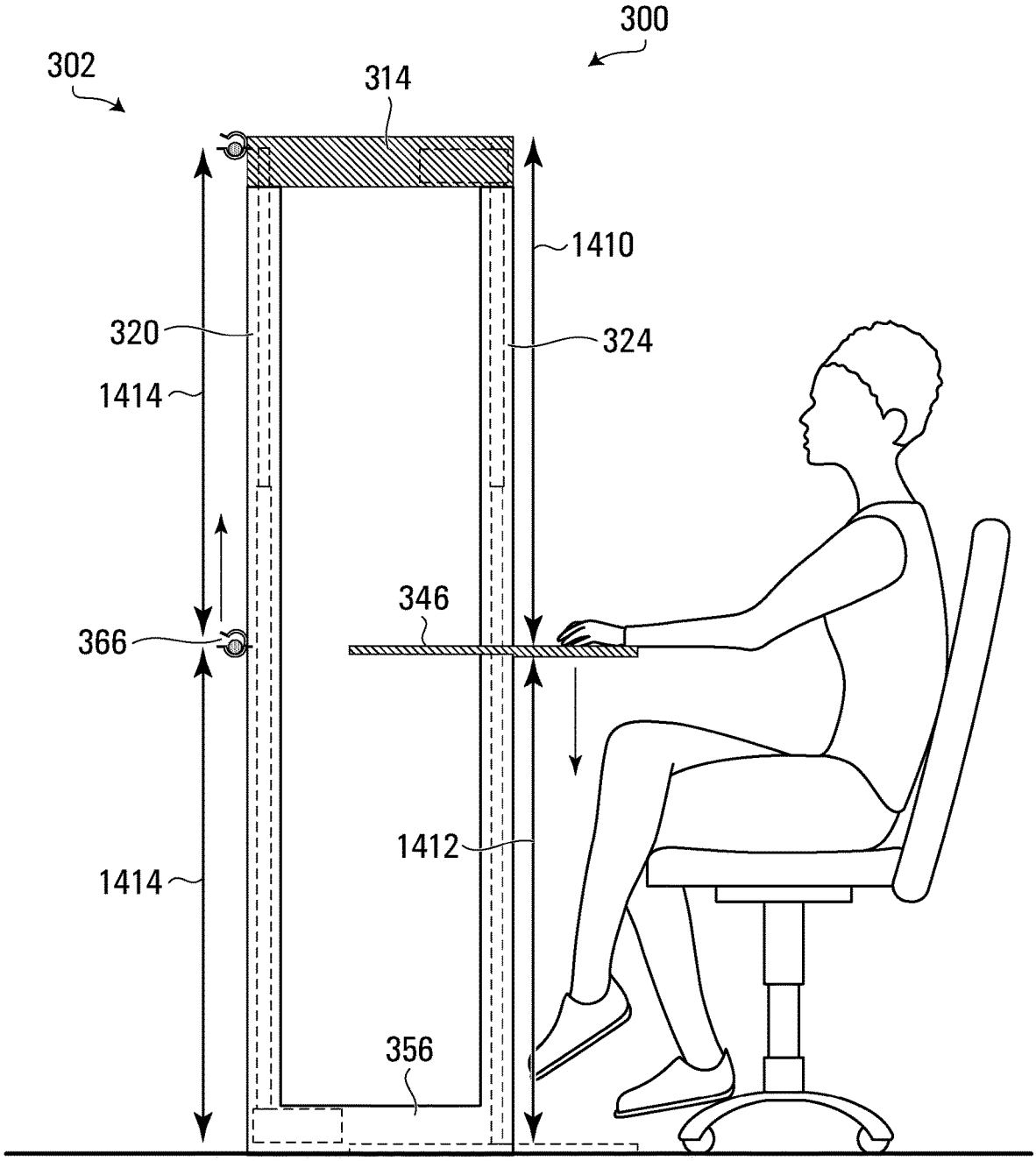
FIG. 14 depicts the sitting in a chair body position attainable by a user of the FIG. 10 workstation.
Figure 15:
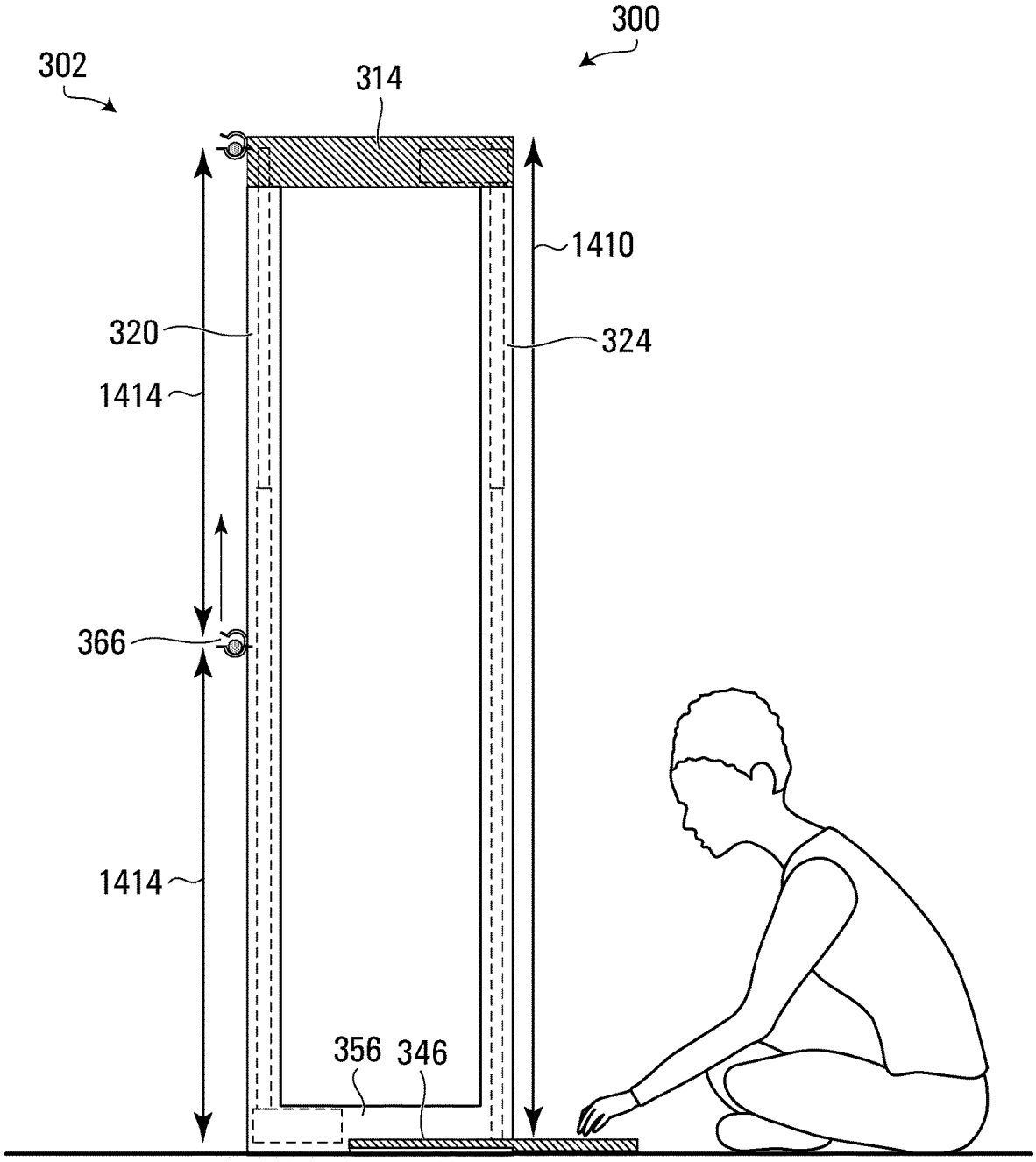
FIG. 15 depicts the sitting on the floor body position attainable by a user of the FIG. 10 workstation.
Figure 16:
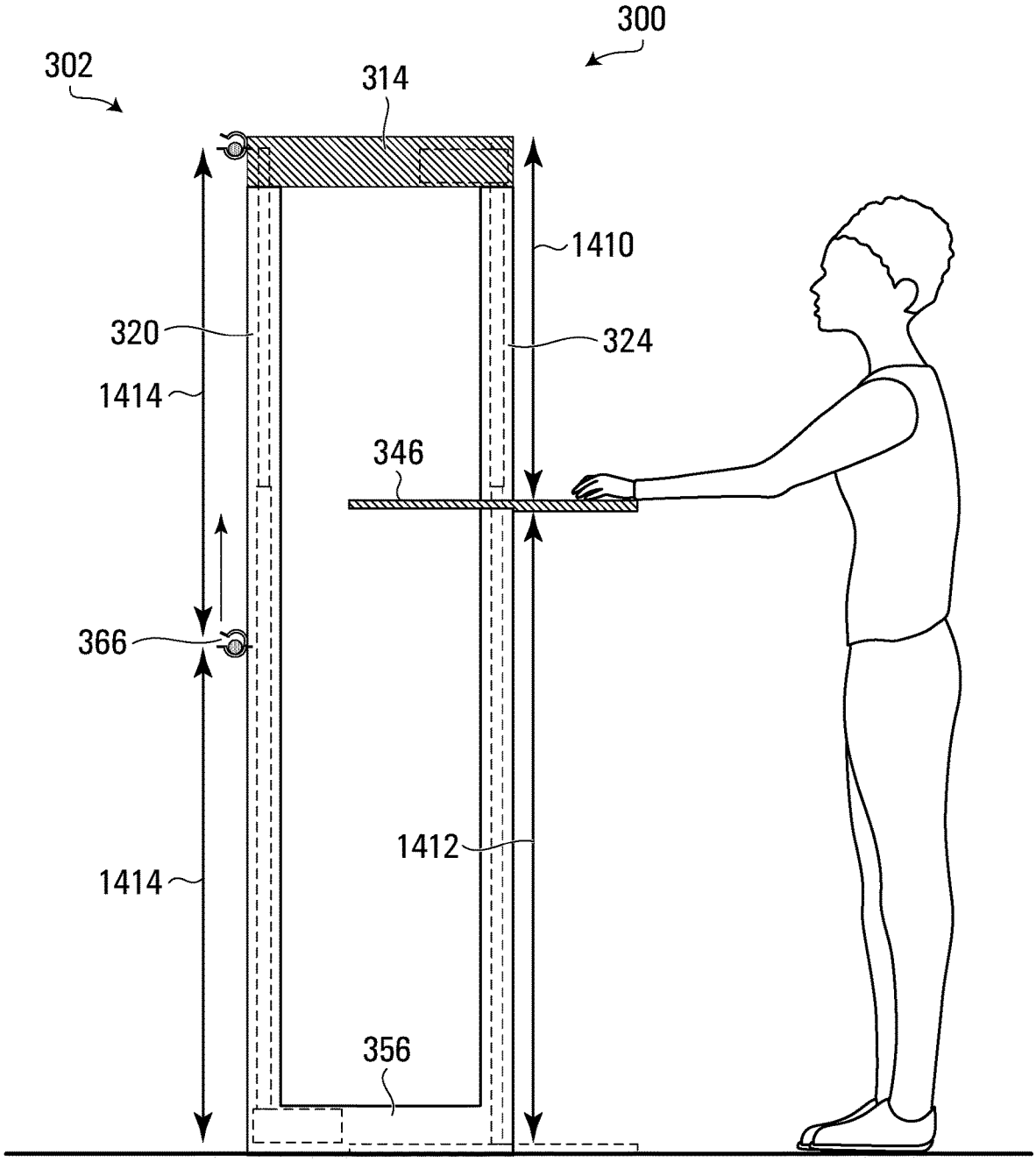
FIG. 16 depicts the standing body position attainable by a user of the FIG. 10 workstation.

Fame 302 may be similar to frame 102 and comprise overhead frame elements defining a covered workspace. As shown in FIG. 10, for example, frame 302 may comprise multiple vertical frame elements such as front vertical frame posts 322 and 324, and rear vertical frame posts 318 and 320. These frame posts may be made of metal, wood, or plastics as these structural elements are required to bear the weight of the apparatus. The overhead fame elements may comprise a front top bar 312, a rear top bar 310, a left top bar 316, and a right top bar 314. Frame 302 also further comprises bottom bars 354 and 356. The overhead frame elements may be made of metal, wood, or plastic, but must be able to resist twisting motions, as they provide structural rigidity for the apparatus. Controller 360 may comprise a computing device, or a generic microcontroller capable of controlling actuators.

Figure 17:
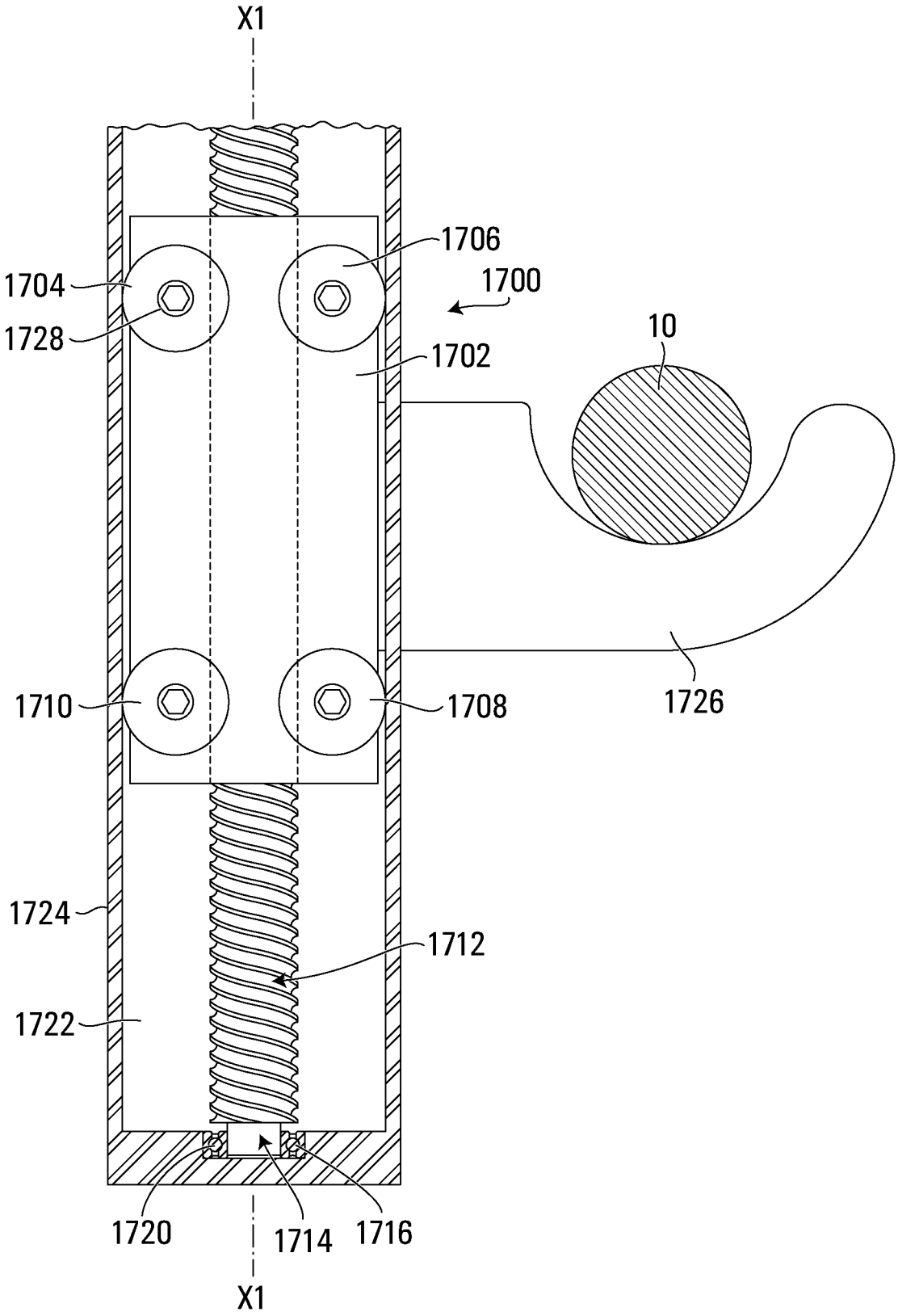
FIG. 17 is a cross section view of the bottom of a vertical support and receiving bolt of the FIG. 10 workstation.
Figure 20:
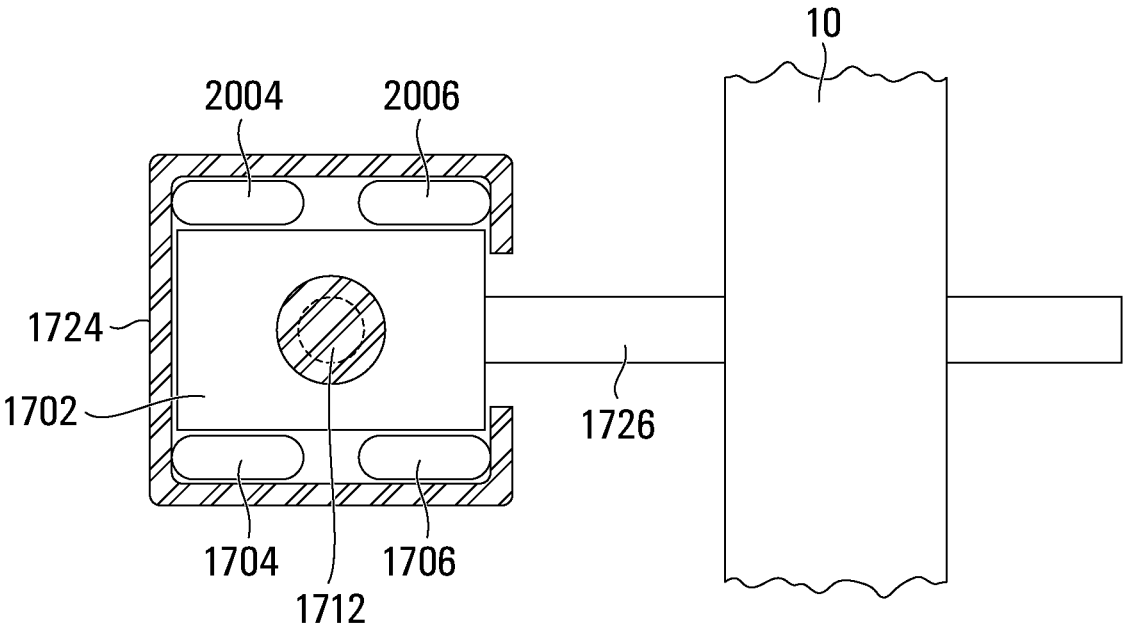
FIG. 20 depicts a cross section view of a vertical support and receiving bolt of the FIG. 10 workstation.

Similar to work surface 146, work surface 346 may comprise a worksurface top 342, and a worksurface bottom 344 as shown in FIG. 10. One embodiment of the work surface 346 may be manufactured from wood. Alternatively, the work surface 346 may be made of metal, ceramic, stone, plexiglass, glass, or a combination of these materials. The work surface 346 size can be variable and customizable. The work surface 346 also may be made of any rigid material that will resist bending and provide a suitable work surface. Actuators 370 and 372 may comprise ball screw actuators, or lead screw actuators. As shown in FIG. 17, actuator 370 may comprise a threaded rod 1712, and rectangular bolt 1702. Actuator 370 may further comprise stabilizing wheels 1704, 1706, 1710, and 1708. There may be wheels on the opposite side of the bolt, as shown in FIG. 20, where stabilizing wheels 2004 and 2006 are shown. FIG. 17 also shows that actuator 370 may comprise a metal casing 1724 surrounding a cavity 1722.

Figure 18:
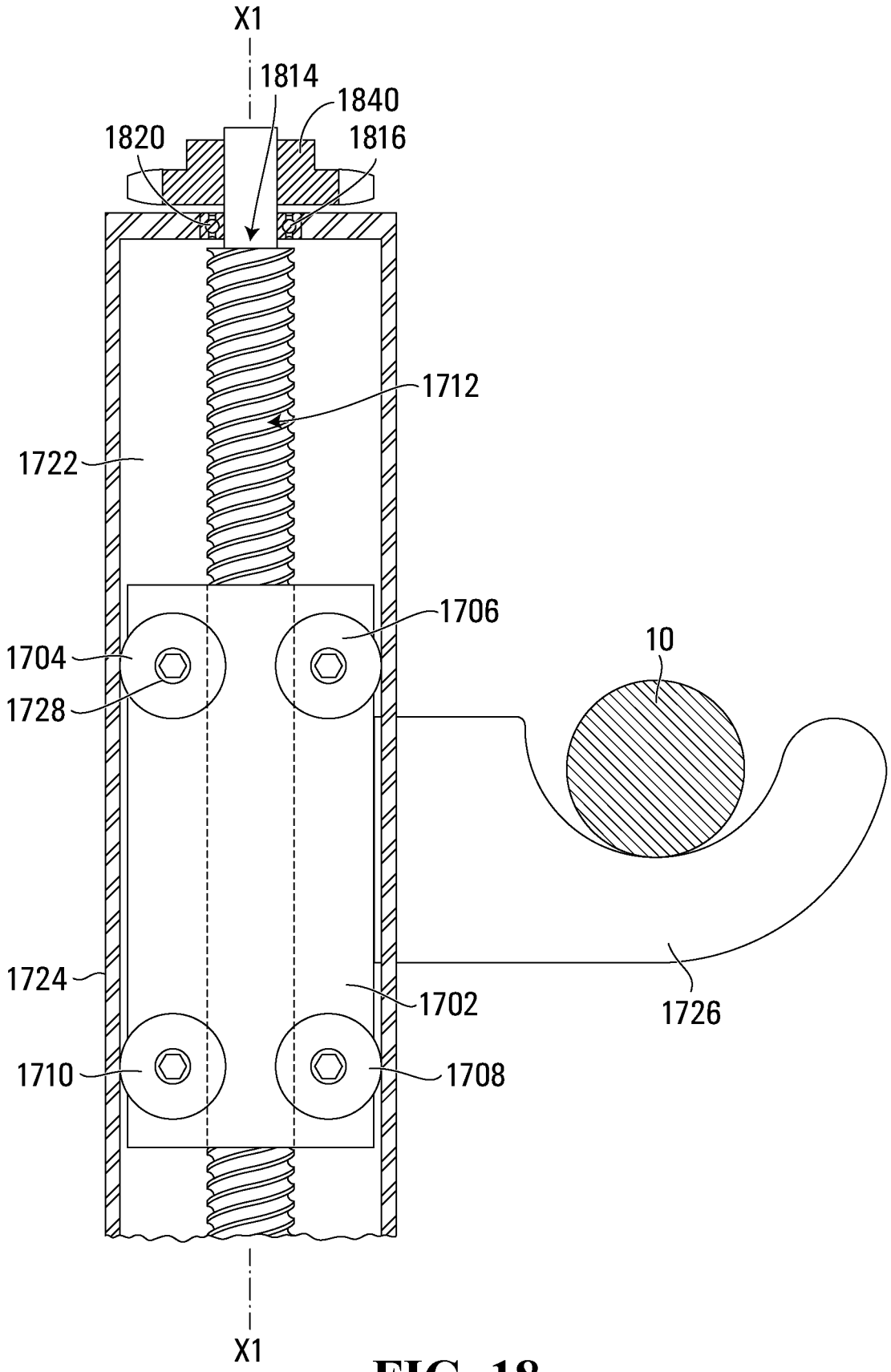
FIG. 18 is a cross section view of the top of a vertical support and receiving bolt of the FIG. 10 workstation.
Figure 19:
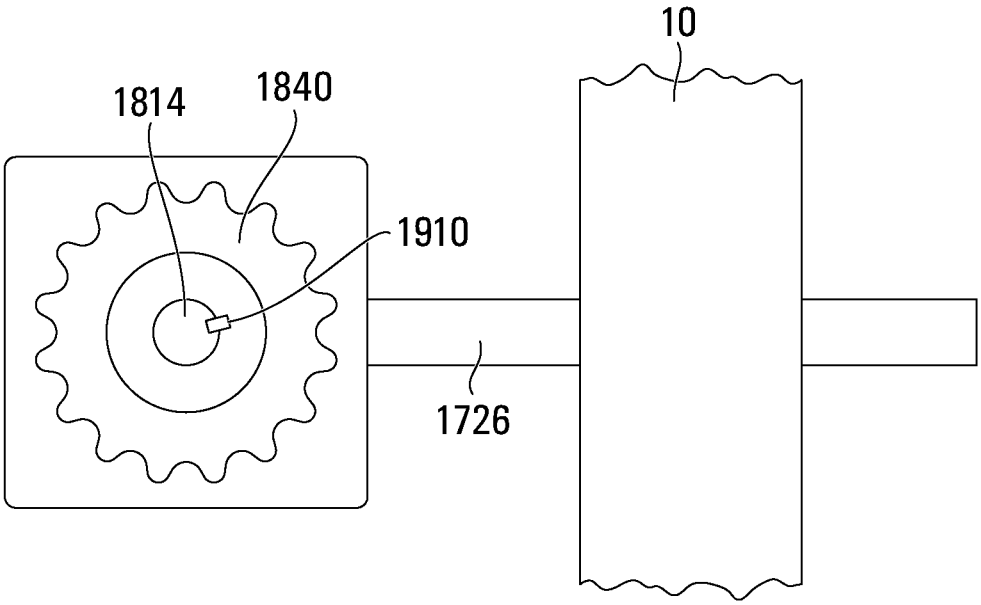
FIG. 19 is a top view of a vertical support of the FIG. 10 workstation.

As shown in FIG. 17, threaded rod 1712 has a non-threaded end 1714 that is designed to be held by bearing 1716. Bearing 1716 may further comprise a plurality of ball bearings 1720. Actuator 370 may further comprise axle bolts 1728 and work surface actuator connections 338 and 340. These actuator connections 338 and 340 may comprise metal or plastic, but they must be able to support the weight of the work surface 346. The work surface actuator connections 338 and 340 may exist only on the work surface top 342, or they may penetrate into work surface 346, or may penetrate through to the work surface bottom 344. As shown in FIG. 18, threaded rod 1712 may have an upper non-threaded end 1814, and actuator 370 may further comprise an upper sprocket 1840, and upper bearing 1820. Upper bearing 1820 may comprise a plurality of ball bearings 1816. As shown in FIG. 19, upper non-threaded end 1814 may have a notch that is designed to fit a sprocket key 1910. actuators 370, 372, 374 and 376 may all comprise similar components such as threaded rods 1712 and bolt 1702. In one embodiment, actuators 370, 372, 374 and 376 may be contained in front vertical frame posts 322 and 324, and rear vertical frame posts 318 and 320. In this embodiment, metal track 1724 may comprise front vertical frame posts 322 and 324, and rear vertical frame posts 318 and 320. In another embodiment, actuators 370, 372, 374 and 376 may be adjacent to front vertical frame posts 322 and 324, and rear vertical frame posts 318 and 320, and they may be contained in steel track 1724.

Methods of manufacturing structure 300 are now described.

As shown in FIG. 10, Frame 302 may be assembled in a rectangular prism shape. The overhead vertical components may be rigidly attached in a rectangular shape. Front top bar 312 may be perpendicularly attached to left top bar 316 and right top bar 314, and rear top bar 310 may be also perpendicularly attached to left top bar 316 and right top bar 314. This may create a rectangular shape where front top bar 312 may be parallel to rear top bar 310 and may be perpendicular to left top bar 316 and right top bar 314. The front vertical frame post 322 may be rigidly attached perpendicular to both left top bar 316 and front top bar 312. The front vertical frame post 324 may be rigidly attached perpendicular to both right top bar 314 and front top bar 312. The rear vertical frame post 320 may be rigidly attached perpendicular to both left top bar 316 and rear top bar 310. The rear vertical frame post 318 may be rigidly attached perpendicular to both right top bar 314 and rear top bar 310. This may result in front vertical frame posts 322 and 324, and rear vertical frame posts 318 and 320 being vertically parallel. Bottom bars 354 and 356 may connect front vertical frame posts 322 and 324 and rear vertical frame posts 318 and 320. Front vertical frame posts 322 and 324, and rear vertical frame posts 318 and 320 may be fixedly attached to the floor, or may be positioned on wheels, skids, or other components that facilitate movement of the workstation structure 300.

As shown in FIG. 17, actuator 370 may be assembled by feeding threaded rod 1712 through rectangular bolt 1702. Actuator 370 may further be assembled by the connection of stabilizing wheels 1704, 1706, 1710, and 1708 to the bolt 1702 using axle bolts 1728. There may be wheels on the opposite side of the bolt, as shown in FIG. 20, where stabilizing wheels 2004 and 2006 are shown. This may result in a bolt that has freely rotating wheels that may allow for free movement of the bolt in the cavity 1722 inside the metal casing 1724. Threaded rod 1712 has a non-threaded end 1714 that is inserted and retained in bearing 1716. Bearing 1716 may contain a plurality of ball bearings 1720 that are positioned such that they are proximate to the non-threaded end 1714. As shown in FIG. 18, threaded rod 1712 may have an upper non-threaded end 1814 that runs through bearing 1816, and into sprocket 1840. Bearing 1816 contains a plurality of ball bearings 1820 that are positioned proximate to the non-threaded end 1814.

As shown in FIG. 19, non-threaded end 1814 may pass through sprocket 1840, and become fixed to the sprocket 1840 by the use of a sprocket key 1910. This sprocket key is inserted into a notch in non-threaded end 1814, and a corresponding notch in sprocket 1840. This key effectively conjoins the non-threaded end 1814 and sprocket 1840 such that rotational movement of non-threaded end 1814 is transferred to sprocket 1840. As shown in FIG. 20, rectangular bolt 1702 may have wheels on both sides of the bolt. This may require a total of 8 wheels (four on each side of the bolt) to center the bolt 1702 in the cavity 1722 of steel track 1724. Steel track 1724 encompasses the entirety of the actuator 370, except for extension 1726, or work surface actuator connections 338 and 340.

These actuator connections 338 and 340 may comprise metal or plastic, but they must be able to support the weight of the work surface 346. The work surface actuator connections 338 and 340 may exist only on the work surface top 342, or they may penetrate into work surface 346, or may penetrate through to the work surface bottom 344. Bar brackets 364 and 366 as shown in FIG. 10 may be perpendicularly attached to actuator bolts 1702. Actuators 374 and 376 may be similar to actuators 370 and 372, but they may not have extensions 1726 extending from bolt 1702, they may connect to bar brackets 364 and 366. Actuators 370, 372, 374 and 376 may be connected inside of rear vertical frame posts 318 and 320 such that they may be contained within the frame posts. Bar brackets 364 and 366 may extend outwards from the frame 302 such that they may be parallel to the floor, and perpendicular to rear vertical frame posts 318 and 320. Bar brackets 364 and 366 must be able to receive and hold exercise bar 20.

Controller 360 may be attached to any elements of frame 302 but is shown in FIG. 10 in an exemplary position as attached to bottom bar 354. Controller 360 may be electrically connected to actuators 370, 372, 374 and 376 and may be connected to actuator bodies 334, 336, 354 and 356 so that the controller may be able to control actuators 370, 372, 374 and 376.

Work Surface 346, similar to work surface 146 may be attached to actuators 370 and 372 by work surface actuator connections 338 and 340. These connections may be fixed or may allow rotation of work surface 346. Actuator 372 may be connected inside front left vertical post 322. Actuator 370 may be connected inside front left vertical post 324. The actuators 370 and 372 may form an extensible connection from the work surface 346 to the overhead components of frame 302.

Operational aspects of workstation 300 are now described with ongoing reference to the drawings.

As shown in FIG. 10, for example, work surface 346 may vertically supported by the overhead frame elements and positionable in the workspace at different work surface heights. Work surface 346 may be raised and lowered vertically along the X1 axis using actuators 370 and 372 by the rotation of threaded rods 1712. Controller 360 may be attached to any elements of frame 302 but is shown in FIG. 10 in an exemplary position as attached to bottom bar 354. Controller 360 may be electrically connected to actuators 370, 372, 374 and 376. Controller 360 also may be connected to actuators 370, 372, 374 and 376 by a network as previously disclosed so that controller 160 may send control signals to actuators 370, 372, 374 and 376 Controller 260 may further be connected to actuator bodies 334 and 336 so that the controller 360 may be able to send control signals to the motors therein. When controller 360 sends control signals and actuator bodies 334 and 336 receive the control signals that correspond to starting operation, actuator bodies 334 and 336 may commence operation of the motors contained inside.

Actuators 370, 372, 374 and 376 may have power provided by electrical wiring that is connected to supply mains. Actuators 1370, 372, 374 and 376 may use electricity provided over the supply mains to operate the motors contained therein. When the motors operate, they may engage with sprocket 1840. The motors may generate and transfer a rotating force to the sprocket 1840 by engaging and providing a rotating force through the teeth on sprocket 1840. When the sprocket 1840 experiences a rotational force, it may transfer this rotational force to the non-threaded end 1814 through sprocket key 1910. This rotating force applied to non-threaded end 1814 may result in threaded bolt 1712 rotating about its linear axis X1. When threaded bolt 1712 is rotating about its linear axis, they may engage and exert a rotational force to the actuator bolt 1702 through the threads on the inside of the bolt. When actuator bolt 1702 is engaged by threaded bolt 1712, it may experience a force in the direction of the rotational axis. This force results in the actuator bolt 1702 moving in the linear actuation direction, parallel with axis X1. When threaded rod 1712 turn clockwise, actuator bolt 1702 may move in one direction parallel with axis X1, and when threaded rod 1712 turns counter clockwise, actuator bolt 1702 may move in the other direction parallel with axis X1. Work surface 346 may be lowerable completely to the floor.

As actuators 370, 372, 374 and 376 extend or retract threaded bolt 1712, they may move the work surface actuator connections 338 and 340 closer to, or further away from left top bar 316 and right top bar 314. The two actuators on the front side (Actuators 370 and 372) and the back side (actuators 374 and 376) must work in tandem, and at the same time and speed to allow work surface 346 to and exercise bar 10 to remain level during raising or lowering. Controller 360 may be responsible for sending control signals to the Actuators 370, 372, 374 and 376 to ensure level raising and lowering of work surface 346. Workstation 300 may further comprise a manual switch to control the actuators and may allow the user to manually raise or lower the work surface 346. Controller 360 may be configured to control the operation of Actuators 370, 372, 374 and 376 to allow for the level raising and lowering of work surface 346. Controller 360 may further comprise a manual switch to control the operation of actuators 370, 372, 374 and 376 to allow for the level raising and lowering of work surface 146 and exercise bar 10.

Similar to what is shown in FIG. 27, connections 338 and 340 may comprise a hinged connector 2500 similar to connection 138 and 142 also, comprising hinge 2506, first hinge plate 2502, and second hinge plate 2504. First hinge plate 2502 may be secured to second hinge plate 2504 by hinge 2506. Hinge 2506 may allow for first hinge plate 2502 to rotate away from second hinge plate 2504 about the hinge 2506 as an axis. Hinge 2506 may have a tightening knob 2508 that may be used to tighten the hinge connector 2500 to prevent rotation and provide a solid connection. Since connections 338 and 340 may comprise hinges, work surface 346 may be tilted for ease of use. One embodiment may have the work surface 346 made to tilt to any angle from horizontal to vertical about hinge 2500. The user may desire a vertical position when using the device entirely for fitness training as it may provide more space for body movement. Users may find various tilt angles of the work surface 346 preferable, similar to those commonly found on drafting tables, to be more comfortable when performing certain work tasks.

Preferably, the adjustable height of work surface 346 may permit a user to work in a standing position, various heights of seated positions, and in various heights of a squatting positions as well as sitting directly on the floor. In a preferred embodiment, the height of the work surface 346 may be adjusted electronically and programmed to various height positions on the X1 axis and programmed to move to various height positions according to set timers. Other behaviors of changing positions may be accomplished by programming the controller 360 to operate the actuators 370, 372, 374 and 376 in response to different criteria. A manually adjustable work surface may be utilized.

Put another way, as described herein and shown in FIG. 10, workstation 300 may comprise an equipment support 364 that may be generally vertically supported by the overhead frame elements and positionable in the workspace at different heights, and the frame 302 further comprises a second actuator operable to move the equipment support 364 between the different heights. The second actuator in workstation 300 may further comprise at least one second linear actuator. The at least one second linear actuator may be located in a channel and may comprise a threaded rod 374 and a receiving bolt 1702, wherein the equipment support 364 is attached to the receiving bolt 1702 through an opening in the channel. The at least one second linear actuator in workstation 300 may comprise ball screws, lead screws, or other types of mechanical linear actuators. The different equipment support 364 heights of workstation 300 may comprise a standing position wherein the equipment support 364 is moved toward the overhead frame elements and a squat position wherein the equipment support 364 is adjacent a floor. The second actuator may be electronically operable to move the equipment support 364. The second actuator may also move the equipment support 364 in response to one or more of a switch, a timer, and a sensor. The second actuator may comprise an electric motor mounted to the frame 302 and may further comprise a power source for the electric motor. The second actuator may comprise a linear actuator operable with an input torque applied by the electric motor. Workstation 300 may be configured where the linear actuator comprises a threaded rod 374 operably engaged with the electric motor and a receiving bolt 1702 operably engaged with the threaded rod 374 and the equipment support 364, and rotation of the threaded rod 374 by the electric motor causes generally vertical movements of the receiving bolt 1702 and the equipment support 364 between the plurality of different equipment support 364 heights. The second actuator may be controlled by a programmable controller 360. The programmable controller 360 may be configurable by software running on a mobile device. The first actuator and the second actuator may be controlled by a single programmable controller 360. The first actuator may be mounted to the frame 302 and the raisable and lowerable work surface 346 so as to vibrationally dampen the raisable and lowerable work surface 346 from an impact force applied to the equipment support 364. Workstation 300 may further comprise one or more of a display, a speaker, a sensor, and an environment modulator that is mounted to the frame and powered by a power source. Frame 302 may be permanently fixable to the floor but may also comprise wheels to allow movement of the frame 302 on the floor.

As shown in FIG. 10, for example, exercise bar 20 may be vertically supported by bar brackets 364 and 366 and positionable at different heights; bar brackets 364 and 366 may be raised and lowered vertically along the X1 axis using actuators 374 and 376 by rotating threaded rods 1712. bar brackets 364 and 366 may be lowerable completely to the floor. As actuator bodies 354 and 356 rotate threaded rods 1712, they may move bar brackets 364 and 366 closer to, or further away from left top bar 316 and right top bar 314. The two actuators must work in tandem, and at the same time and speed to allow bar brackets 364 and 366 to remain level during raising or lowering. Controller 360 may be configured to control the operation of actuators 374 and 376 to allow for the level raising and lowering of bar brackets 364 and 366. The raising and lowering of bar brackets 364 and 366 operate in a similar fashion to the raising and lowering of work surface 346.

The exercise bar 20 may preferably be adjustable in vertical position to permit users of differing heights to suspend themselves by their arms from the bar. In a preferred embodiment, the bar may be adjustable in increments of 2-3 inches up to 9 feet from the floor. In another possible embodiment, actuators 374 and 376 could adjust the height of an exercise bar 20 by a range variable depending on the range capable by actuators 374 and 376 and the position installed in the device. For example, the exercise bar 20 movable by actuators 374 and 376 may be adjusted in height from 6.5 feet to 8.5 feet from the floor, or 7-8 feet, or other range. One embodiment may have the hanging bar actuators 374 and 376 programmed to lower to a height the user may easily grasp and then raise and lift the user to a height where the feet are clear of the floor. In a preferred embodiment, the height of the bar brackets 364 and 366 may be adjusted electronically and programmed to various height positions on the X1 axis and programmed to move to various height positions according to set timers. Other behaviors of changing positions may be accomplished by programming the controller 360 to operate the actuators 370 and 372 in response to different criteria. Bar brackets 364 and 366 may further comprise a clamping feature wherein the receptacle of the bracket may constrict or further enclose the circumference of exercise bar 20. This restriction may provide rigidity and allow for use with more exercises that require a rigidly mounted bar. The workstation also may comprise safety mechanisms that would prevent the exercise bar 20 or the work surface 346 from moving inadvertently.

The controller 360 may be further controlled by a program that changes the height positions of actuators 370, 372, 374 and 376. The program may produce, inspire, and motivate movement activities during the workday. Users may program different work surface 346 height levels and the time spent in each position and may program a slow continuous movement of the surface which would inspire changes in body positions. The programming may offer activity nudges for stretches and exercises interspersed through the workday. The controller 360 may be further controlled by a remote application running on a mobile device, that is configurable by the user. This mobile application may comprise further functionality such as the ability to set goals and configure the workstation to be set up for exercises targeting certain areas of fitness. The mobile application also may be able to configure controller 360 to operate actuators 370, 372, 374 and 376 simultaneously, or independently to create workstation configurations that are not possible using controller 360 alone. Mobile application also may allow multiple workstations to be controlled at once and may allow the configuration of one workstation be applied to another workstation in order to mirror the height or motion settings.

Additional aspects of the present disclosure are now described with reference to FIGS. 23 and 24, which show different variations of frame 102, 202, or 302, each of which may assume any size and geometric shape, including free-standing and/or wall attached. Another embodiment of the apparatus may have differing numbers of vertical posts. The workstation may be free standing and may use up to four vertical posts to comprise the overhead portion. Workstation 100 is an example of a four-post workstation. FIG. 23 depicts a wall mounted desk 600, that does not use any vertical posts. The workstation in FIG. 23 uses guides attached to the wall to guide the work surface as it is raised and lowered by the actuator in the middle of the work surface. At the top of the workstation there is a housing that contains the motors, actuators, controller, and other electrical circuitry required for operation of the work surface. FIG. 24 depicts another exemplary embodiment similar to the workstation in FIG. 23, wherein the wall-mounted workstation 602 further comprises a fixed exercise rack, that allows for use of an exercise bar, while requiring minimal floor space. This exercise rack may be straight, angled, or curved. The exercise rack may comprise all, or only a portion of the posts that are connected to the workstation.

Figure 25:
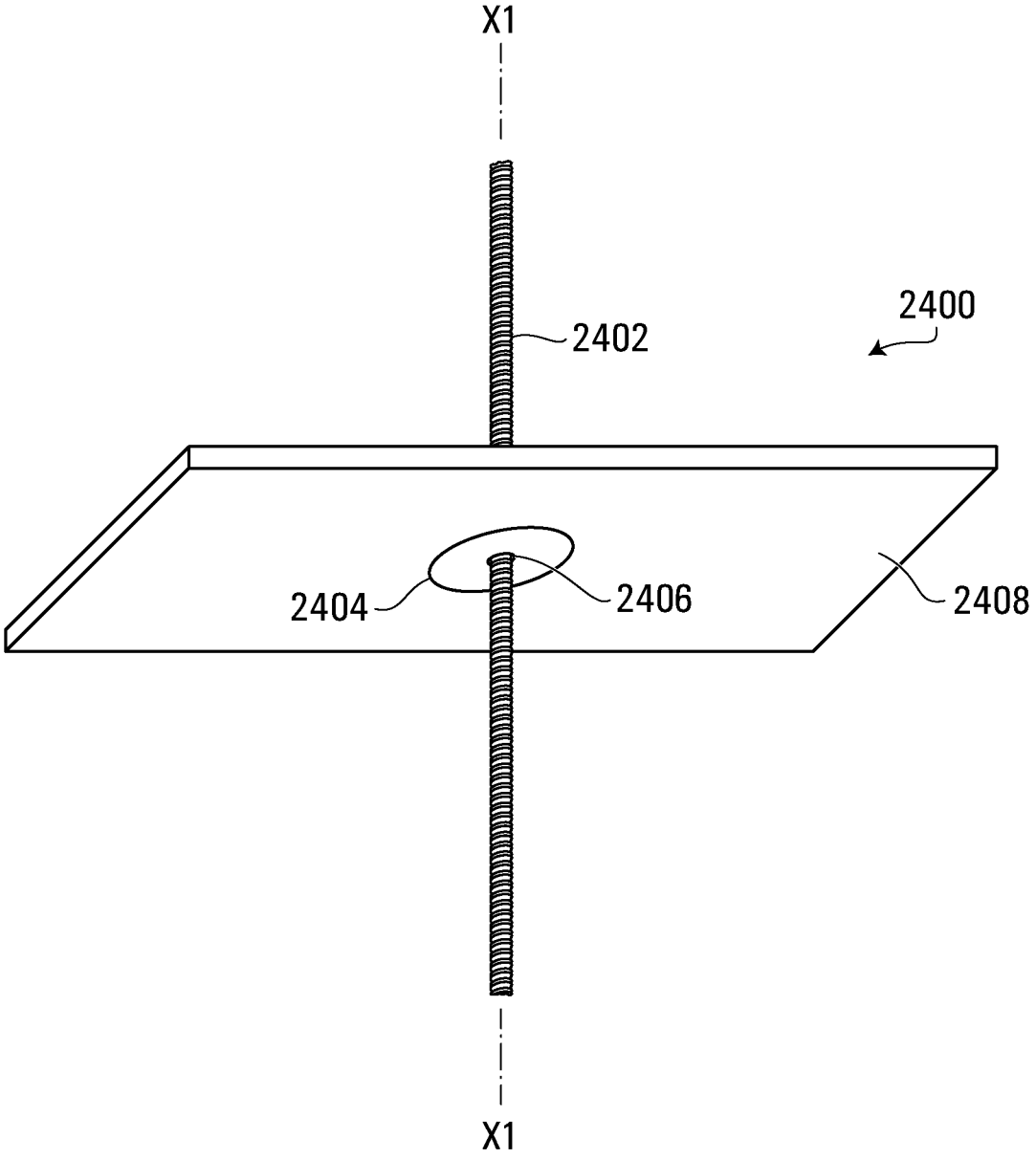
FIG. 25 is a perspective view of a work surface with an embedded actuator motor.

Additional aspects of the present disclosure are now described with reference to FIG. 25, which shows a different variation of the work surface. As shown in FIG. 25, workstation 100 may comprise a work surface 2400 that is similar to work surface 146 shown in FIG. 1. Work surface 2400 may comprise a movable work surface 2408, an internal actuator motor 2404 and an orifice 2406 with which to engage a threaded rod 2402.

As shown in FIG. 25, movable work surface 2408 may comprise wood, metal, composite, or other sturdy material with which a user would want to work on. Internal actuator motor 2404 may be attached to work surface 2408. For example, a housing of internal actuator motor 2404 may comprising holes extending therethrough to permit attachment of motor 2404 to surface 2408 with screws extending through the holes for attachment to an underside of surface 2408. As a further example, the housing of motor 2404 also may be embedded inside of a cylindrical opening extending into the underside of surface 2408; and may have side surfaces attachable to interior surfaces of the opening.

Internal actuator motor 2404 may comprise any type of driven motor. As shown in FIG. 25, motor 2404 may comprise an electric drive motor, orifice 2406 extending through motor 2404 to receive threaded rod 2402, an internal thread engageable with the threads of rod 2402 to move work surface 2408, and a gearless electromagnetic drive element operable to rotate the internal thread in a first direction to move work surface 2408 upward and a second direction to move work surface 2408 downward. In keeping with this example, actuator motor 2404 may comprise an axial direct drive motor, a radial direct drive motor, and a gear driven drive motor, such as those manufactured and sold by Genesis Robotics & Motion Technologies under the name LiveDrive®. This embodiment may simplify the workstation 100 shown in FIG. 1, as fewer parts are needed, and fewer parts move. This also may reduce the amount of bracing, steel track, and other components required to facilitate moving threaded rods of traditional ball screws or leadscrews.

Aspects of this disclosure are now described with reference to an exemplary computer-implemented method 400 for configuring and operating workstation 300. For ease of description, such aspects are described with reference to workstation 300 shown in FIGS. 10 to 20 but could also be described with reference to any workstation described herein, such as workstation 100 or 200.

A mobile application 450 that implements method 400 may be downloadable onto any computing instrument, such as a laptop or desktop computer, smartphone, or tablet. The mobile application 450 may send commands using Bluetooth to controller 360 and also may receive information from the controller 360 mounted to the workstation 300. The controller 360 may send commands and may receive information from the motors inside actuators 370, 372, 374, and 376 that control work surface 346 position and exercise bar 20 position.

Figure 22:
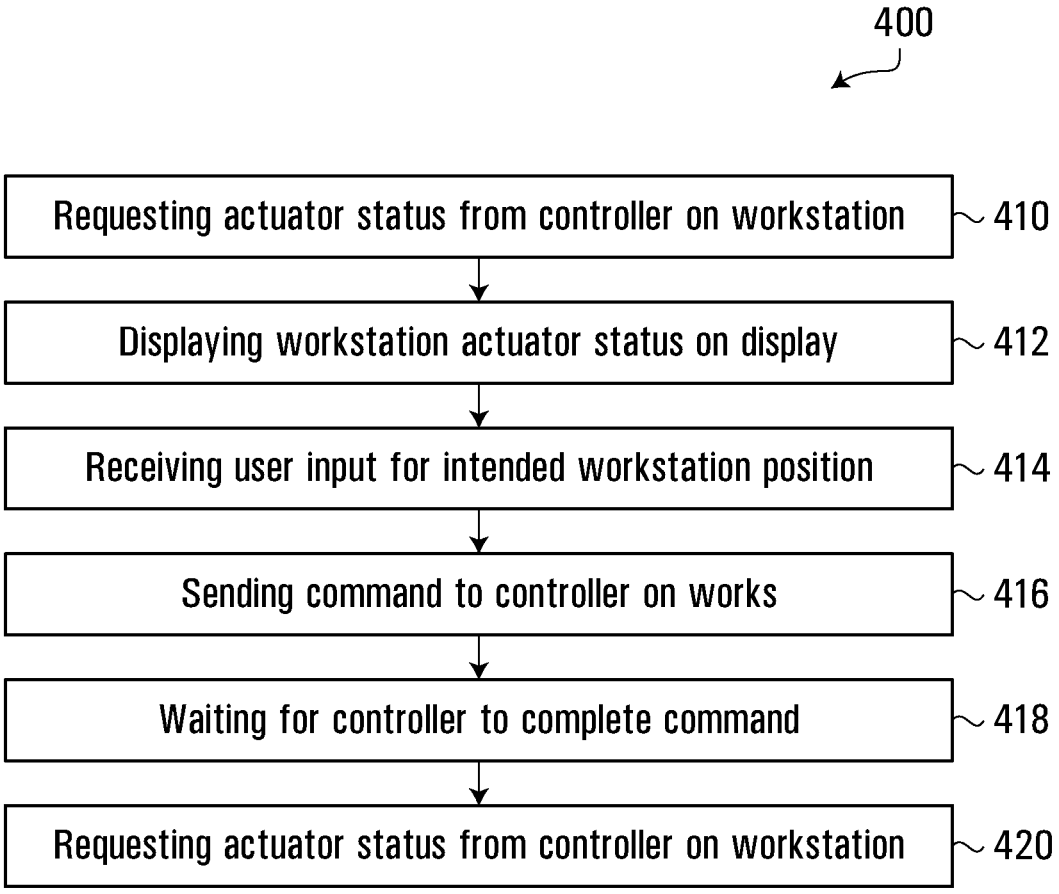
FIG. 22 depicts a software method for use with the FIG. 10 workstation.

As shown in FIG. 22, for example, mobile application method 400 may comprise: (i) requesting actuator status from the controller on workstation (a step 410); (ii) displaying workstation actuator status on the mobile display (a step 412); (iii) receiving user input for intended workstation position (a step 414); (iv) sending commands to the controller on the workstation (a step 416); (v) waiting for controller to complete command (a step 418); and requesting actuator status from controller on the workstation (a step 420).

As shown in FIGS. 10 and 22, step 410 of requesting actuator status from the controller on the workstation may comprise a mobile application 450 operating on a mobile device querying actuators 370, 372, 374, and 376 by way of the controller 360, either by proxying requests through the controller 360, or requesting the status from the controller 360 itself, and then waiting for the controller to request statuses from actuators 370, 372, 374, and 376. The controller 360 may maintain an internal record of the statuses of actuators 370, 372, 374, and 376 and may be able to respond to the request without having to query the actuators 370, 372, 374, and 376 in this step 410. The communication between the mobile device, the controller 360, and with the actuators 370, 372, 374, and 376 may be electrical, optical, or wireless, as the connection between the controller 360 and the actuators 370, 372, 374, and 376 may be wired, or wireless. The controller 360 may also rely on sensors, or other gauges to determine the status of actuators 370, 372, 374, and 376, and/or work surface 346 and/or exercise bar 20.

As shown in FIGS. 10 and 22, step 412 of displaying workstation actuator status on the mobile display also may comprise displaying the actuator status on the display of the mobile device via the mobile application 450 as a percentage of maximum actuation, or as a calculated height of the workstation work surface 146, or exercise bar 20 height from the floor. The actuator status also may be displayed as a non-numeric representation, such as an analog gauge, or a slider on a scale. The representation may be a visual depiction of the actual status of the workstation 300, and may be in two, or three dimensions. These representations may allow a user that cannot see the workstation 300 to understand and visualize how the workstation 300 is currently configured, and to give the user an option to modify the workstation 300 configuration if the user desires.

As shown in FIGS. 10 and 22, step 414 of receiving user input for intended workstation position may comprise prompting the user to enter or modify the intended workstation 300 position and configuration. The user may be presented with a variety of input controls, such as numerical inputs, sliding inputs, or analog dials/gauges with which to interact. Once the user has entered the desired configuration state into the mobile application 450, the mobile application 450 may translate the user input into controller commands. This may involve using translation tables or may involve reformatting the user input into a format that the controller 360 can use.

As shown in FIGS. 10 and 22, step 416 of sending the command to the controller on the workstation may comprise the mobile application 450 sending the desired workstation 300 configuration to the controller 360. This communication may be done wirelessly, or via electrical or optical communication. The controller 360 may acknowledge the receipt of the request, or it may simply proceed to process the request. The controller 360 may respond that the request is not valid, was not received correctly, or is otherwise unusable. The controller 360 may allow for the request to be re-sent by the mobile application 450 so that the user does not have to be prompted for input when a simple request re-send would solve the issue. The controller 360 may provide a response when the request is completed. The controller 360 may provide a response with an approximated wait period before requesting status to prevent the mobile application 450 from unnecessarily querying the actuator status.

As shown in FIGS. 10 and 22, step 418 of waiting for controller to complete the command may comprise the mobile application waiting a pre-set minimum time before requesting the actuator status of actuators 370, 372, 374, and 376 from the workstation 300. This wait period may prevent false failures, by allowing the controller 360 time to process the request, and to run its own verification checks on the actuators 370, 372, 374, and 376. If the controller 360 responded with an approximated wait period, the mobile application 450 may use this wait period, or it may calculate its own wait period with which to use. If the calculated wait period of the mobile application 450 and the approximated wait period of the controller 360 are not approximately similar, the mobile application 450 may alert the user that there may be a configuration or hardware issue that may require attention.

As shown in FIG. 22, step 420 of requesting actuator status from the controller on the workstation may comprise re-requesting the status of actuators 370, 372, 374, and 376 from the controller 360 similar to step 410. This request allows the mobile application 450 to verify that the user configuration sent to the controller 360 has been successfully applied. This verification step may be repeated to confirm that a false positive has not been received.

Further aspects of this disclosure are now described with reference to another exemplary computer-implemented method 500 for providing anti-collision functionality of workstation 300. For ease of description, such aspects are described with reference to workstation 300 shown in FIGS. 10 to 18 but could also be described with reference to any workstation described herein.

Figure 26:
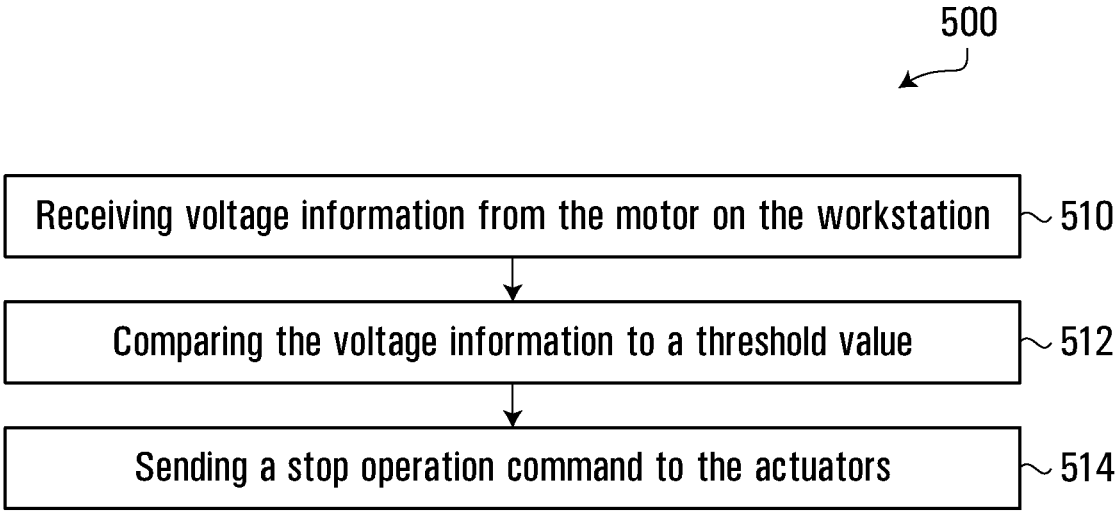
FIG. 26 depicts another software method for use with the FIG. 10 workstation.

As shown in FIG. 26, for example, controller method 500 may comprise: (i) receiving voltage information from the motor on the workstation (a step 510); (ii) comparing the voltage information to a threshold value (a step 512); and (iii) sending a stop operation command to the actuators (a step 514).

As shown in FIGS. 10 and 26, step 510 of receiving voltage information from the motor on the workstation may comprise the controller 360 constantly monitoring and receiving voltage information from the motors inside actuators 370, 372, 374, and 376. This voltage information may be time based, deviation from a norm based, or may take other formats that can be used in a comparative manner. The controller 360 may log, cache, or record this information for future use, or for performance reasons. The voltage information represents the resistance that the motors inside actuators 370, 372, 374, and 376 are experiencing during operation.

As shown in FIGS. 10 and 26, step 512 of comparing the voltage information to a threshold value may comprise the controller 360 comparing the voltage information received from actuators 370, 372, 374, and 376 to a threshold value. This threshold value represents the maximum resistance that the motors inside actuators 370, 372, 374, and 376 are allowed to encounter before being required to stop. If the voltage information received is less than the threshold value, then the motors inside actuators 370, 372, 374, and 376 are not encountering resistance, and will be allowed to continue, and will return to step 510. If the voltage information received from actuators 370, 372, 374, and 376 exceeds the threshold value, then it represents that the exercise bar 20 or the workstation work surface 346 have encountered higher than normal resistance, or have encountered a collision requiring a stop command, and will proceed to step 514.

As shown in FIGS. 10 and 26, step 514 of sending a stop operation command to the actuators may comprise the controller 360 sending a stop operation command to actuators 370, 372, 374, and 376 to stop their internal motors from operating. This may prevent work surface 346 or exercise bar 20 from being further involved in a collision, or from being damaged due to contact with whatever object or situation caused the higher than normal resistance in step 512. This step may further comprise the controller 360 sending a reverse command to actuators 370, 372, 374, and 376 to have actuators 370, 372, 374, and 376 reverse the direction of their internal motors, which may move work surface 346 and/or exercise bar 20 in the opposite direction than they were in step 510 to provide a release or relief of the resistance.

In other words, method 500 describes an anti-collision system that aborts motion of the work surface 360 or exercise bar 20. This may be established by the controller 360 sending a stop operating command to the motors in actuators 370, 372, 374, and 376. When the controller 360 receives information from the motors in actuators 370, 372, 374, and 376 that there may be a spike of voltage utilization it may be indicating that they have come up to some resistance to motion. The degree of voltage spike required to initiate the anti-collision may be adjusted by the user and may make the workstation 300 more or less sensitive to collision.

In another embodiment, the mobile application may contain an automated system that allows customization and scheduling of the physical settings of the workstation, as well as monitoring and maintaining a history of the user's metrics such as: how long the workstation has remained in each position, repetitions of positions, and order of positions. Customization opportunities provided by the mobile application may include programming as many height levels as desired, time spent at each height level, and cycles of various height levels in a day. An alert sound or tone may be supplied by the mobile application at a period of time and may be customizable by the user before the initiation of movement to the next programmed height level. This may allow the user to prepare for change in work surface height or abort the upcoming movement should they so desire.

The monitoring and maintaining of user metric data may provide the opportunity for a Work Health Diary and a Fitness Goal Setting. By recording subjective feelings like pain or fatigue, among others, at the start and end of each work shift, the user may evaluate and select the daily programming most suited to them. With metric monitoring the user also may set graduated fitness goals, like to sit less, or spend more time in a deep squat, through the day. In addition to inputting subjective feelings a user also may want to record metrics such as average heart rate and calories burned that can be determined by third-party applications. The workstation provides many exercise opportunities and a user may plan to target fitness goals such as an overall higher heart rate and/or calories burned during the work shift. The user also may record performance of various rehabilitative or fitness building exercise in the Work Health Diary/Fitness Goal Setting to monitor progress.

Other embodiments of the mobile application may involve adaptive abilities of the Workstation to meet the health levels, rehabilitative needs, and fitness goals of the user. This adaptive ability may involve evaluating daily subjective input and give recommended adjustments to the daily scheduling. For example, the user may report being very fatigued from lack of sleep and the mobile application may make suggestions on the user's own programmed schedule to be conservative on energy requirements so that the user may have as productive a day as possible. Alternatively, a user may report at the start of a shift having been in a car accident and experiencing neck pain. The mobile application may show a history of pre-injury abilities, may make suggested modifications to scheduling for injury rehabilitation, and may make continued modifications as the user recovers.

The present workstation provides opportunities to exercise the strength and flexibility of the muscles and joints of the body while performing work tasks that were once performed in work stations which only provided work surface height at sitting or standing positions or only offered change between sitting and standing positions. A first exercise opportunity with this workstation while performing office work may be provided by a changing height work surface that allows many postures and positions, not only the sitting and standing positions offered by current sit-stand models but also full squat/sitting on ankles/sitting on floor positions. These levels may be changed as desired or programmed into pre-set heights specific for the worker's standing, sitting, squatting, and sitting on the floor levels and set to timers to move the work surface and may prompt the user to change positions. This variability of the surface level may allow for change of static use of the lower limbs to stimulate the connective tissue of muscles and joints in many degrees throughout their full range of motion.

A second exercise opportunity may be provided by the adjustable overhead bar by which to suspend body weight by the hands to stimulate strength and flexibility of the muscles and joints of the upper limbs. Another set of exercise opportunities may be possible in a preferred embodiment as depicted in FIG. 3 where the bar could be located at a position 30 inches off the floor so that the user could do bench presses, and 2-3 inch increments up to 6 feet to accommodate the various sizes of users' bodies, as well as other various weight training exercises including but not limited to inclined presses, shoulder presses, shoulder shrugs, and squats.

In alternate embodiments of the workstation such as shown in FIG. 3, the device may need to be placed next to a wall on the side of the work surface. In this embodiment, the surface would not overhang the structure but may be located entirely within it, so that the work surface would continue to be useable while the workstation is against the wall.

Another embodiment of the device may have a built-in floor system that can lift open and fold closed revealing different types of surfaces including but not limited to various degrees of floor cushioning, balance training surfaces, and acupressure matts of various pressure point sizes. Alternatively, another embodiment may have these matts rolled out from containers attached on the either side of the bottom of the frame. A preferred embodiment may include a bar specifically ordered to the user's request. The bar may span 52" to the weight collars and may be available in diameters such as 25 mm, 28, 30, and 32 mm. The bar may be available in weight ranging from 10 lbs to 100 lbs in 5 lb increments. The device may be sold with and/or include anchors for attaching the device to a floor, wall, or ceiling; levelling feet; and/or wheels on one side so that the user may easily re-locate the device by slightly tipping the unit to engage the wheels and then rolling it to a new location.

According to an alternate embodiment of the workstation, there may be provided electronic sensors (e.g., like that of 10 which register time spent or repetitions made sitting, standing, variations of squatting, or hanging as well as the performance of stretching and strengthening exercises. This may allow the user to monitor time spent in various positions and repetitions made of various activities and to set fitness goals. One embodiment of the workstation would provide customizable workday fitness and rehabilitative programs software that prompts the worker into a new position or activity through the day, and that would provide monitoring reports. These software programs may be installed into the user's computer or into the integrated controller. Another embodiment may have a clock/timer, a monitor, and speakers incorporated into the frame along with the computer system. Another embodiment may have built in, environment modulating components such as full spectrum lights, fans, heaters, air purifiers, humidifiers, or other components.

An alternate embodiment may have a set of drawers specifically designed to accompany the workstation that may be attached and detached and moved from one side to the other. An embodiment of the device would have a power outlet and/or USB outlet installed onto either the top or underside of the work surface. The workstation may be considered a hybrid of a fitness station and an office station. As such, users may have more opportunity for movement and change in positions than simple sit-to-stand workstations. It may offer opportunities for sit-stand-squat-reach-climb-hang-lift-suspend-pull-press-dip-curl-shrug-step-jump-stretch-and-strength training actions at the workstation. The work surface may be adjustable between a lowermost position of about 3-5" off the floor, and an uppermost position 48-50" above the floor. According to one embodiment, the work surface may be adjusted to discrete heights between the lowermost and uppermost positions. According to an alternate embodiment, the work surface may be adjusted to any height between the lowermost and uppermost positions.

Another embodiment may put increased emphasis on the fitness apparatus, in which the support frame would be made larger, heavier, and stronger for heavier and more intense fitness training, with an attached office work surface. Another embodiment may have a rechargeable battery integrated into the workstation to which the cardio devices would connect and charge up during exercise. The energy stored in the battery by exercise could then be a power source to power the various electronic devices used while doing office or fitness activities.

According to one embodiment, specific attachment hardware would be incorporated into the support frame at floor level, various vertical positions to the top of the frame, and overhead at the top of the frame for the attachment of resistance bands and tubing for strengthening and rehabilitative exercises. The high horizontal component of the back part of the frame affords opportunity for the hanging of gymnastic rings for strength training. One embodiment would have this component of the frame made of a metal bar 25-32 mm in diameter that could be used not only for placement of gymnastic rings but hanging and pull ups by tall users. Other accessories are possible. According to one embodiment, the support frame may be provided with means for storing the various accessories. Various stretches may be performed using the adjustable hanging/exercise/suspension bar (e.g. hamstring) and support frame (e.g. pecs). Users also may exercise with fitness accessories specifically made to accompany the invention such as balance training matts; wobble boards; stationary bikes; elliptical trainers; mini steppers; pedlars; elliptical devices; and adjustable dumbbells, among others. One embodiment may have a computing and software system integrated into the structure. The exercise accessories can be connected by sensors to the computing system and software installed into the device. The device's built-in computer and software would monitor repetitions and time spent doing various fitness activities, allowing users to set fitness goals and chart progress.

Additional exercise opportunities may be provided through use of various accessories included with the workstation. Three attachable or detachable to each other rectangular sit-step-jump-bench boxes made of wood, foam, or vinyl, attachable to or detachable from one another, as shown in the figures, may provide many positional and movement opportunities. These opportunities may include sitting positions 8", 11", 15", 5 18", 24", 26", 32" from the floor; 15" high benches for weight training that are 11" wide and 32", 42", or 50" long; stepping exercise at various heights of the boxes; and jumping exercise (plyometrics) at various heights of the boxes. Another exercise opportunity may be an accessory set of boards which may be used individually or in combination to lift a user's heels as a progression of a full squat, to perform calf raises, or stretch calves and ankles while in the standing position. Another accessory may be a 60" dowel for performing shoulder mobility and stretching exercises. Posts with lacrosse balls attached at the ends, adjustable to different heights on the support frame, may be used for pressure release of tension and knots in the shoulders, back, and hips.

Aspects of methods 400 and 500 may be modified accordingly to accommodate any variation of workstation 100, 200, and 300.

While principles of the present disclosure are described herein with reference to illustrative aspects for particular applications, the disclosure is not limited thereto. Those having ordinary skill in the art and access to the teachings provided herein will recognize additional modifications, applications, aspects, and substitution of equivalents all fall in the scope of the aspects described herein. Accordingly, the present disclosure is not to be considered as limited by the foregoing description.

Embodiments in which an exclusive property or privilege is claimed are defined as follows:

1. An apparatus comprising:

a frame comprising a post;

a work surface that is movably attachable to the post and selectively positionable at a plurality of different work surface heights relative to the post, the plurality of different work surface heights including a standing height, a seated height, and a floor height;

a motor contained in an upper portion of the frame; and an actuator that is contained in the frame, rotatably attachable to the motor in the upper portion of the frame, and operable with the frame when rotated by the motor to move the work surface along the post within a range of movement including the plurality of different work surface heights while maintaining an orientation of the work surface relative to the post, the actuator comprising an actuator member that is contained in the post and operable when the actuator is rotated to cause vertical movements of the work surface within the range of movement and stabilize the work surface during the vertical movements.

2. The apparatus of claim 1, wherein the actuator comprises at least one linear actuator.

3. The apparatus of claim 2, wherein the at least one linear actuator comprises ball screws or lead screws.

4. The apparatus of claim 1, wherein the plurality of different work surface heights comprise one or more of:

a standing position where the work surface is moved vertically away from a floor to the standing height, allowing a user to access the work surface while standing on the floor;

a squat position where the work surface is moved vertically toward the floor to the floor height, allowing the user to access the work surface while squatting, sitting, or lying on the floor;

a seated position where the work surface is moved vertically away from the standing height or the floor height to the seated height, allowing the user to access the work surface while sitting on a chair on the floor; and a ceiling position wherein the work surface is moved vertically away from the floor to a ceiling height that is above the standing height, the seated height, and the floor height.

5. The apparatus of claim 1, wherein the actuator is electronically operable to move the work surface within the range of movement in response to one or more of a switch, a timer, a sensor, a programmable controller, and a mobile device.

6. The apparatus of claim 5, wherein the actuator comprises a linear actuator operable with an input torque applied by the motor to cause the vertical movements of the work surface within the range of movement.

7. The apparatus of claim 1, wherein:

the actuator comprises a threaded rod that is rotatably mounted and vertically fixed in the post between an upper rotational bearing contained in the upper portion of the frame and a lower rotational bearing contained in a lower portion of the frame;

the actuator member is operably attached to the threaded rod and the work surface so that rotation of the threaded rod between the upper rotational bearing and the lower rotational bearing with the motor causes the vertical movements of the work surface within the range of movement; and the actuator member comprises threads that are operable with corresponding threads of the threaded rod to cause the vertical movements of the work surface when the threaded rod is rotated, stabilize the work surface during the vertical movements, and maintain a vertical position of the work surface at each height of the plurality of different work surface heights when the threaded rod is not rotated.

8. The apparatus of claim 7, comprising:

an elongated opening extending into the post; and a connector that extends through the elongated opening and is attached to the actuator member so that work surface is vertically supported by the actuator member.

9. The apparatus of claim 1, wherein the actuator member comprises one or more of:

exterior surfaces that act on the post to maintain the orientation of and stabilize the work surface during the vertical movements;

a plurality of wheels that act on the post to stabilize the work surface during the vertical movements; and axles extending through the actuator member to position the plurality of wheels against interior surfaces of the post.

10. The apparatus of claim 1, comprising an equipment support that is operable with the frame to position a piece of exercise equipment at a plurality of different equipment support heights relative to the frame.

11. The apparatus of claim 10, wherein the equipment support is removably attachable to the frame.

12. The apparatus of claim 11, wherein the piece of exercise equipment comprises an exercise bar that is vertically supportable by the equipment support at the plurality of different equipment support heights.

13. The apparatus of claim 10, wherein:

the frame comprises a second post; and the apparatus comprises:

a second motor contained in the upper portion of the frame; and a second actuator that is contained in the frame, rotatably attachable to the second motor in the upper portion of the frame, and operable with the frame when rotated by the second motor to move the equipment support along the second post within a second range of movement including the plurality of different equipment support heights while maintaining an orientation of the equipment support relative to the second post.

14. The apparatus of claim 13, the second actuator comprising a second actuator member that is contained in the second post and operable when the second actuator is rotated to cause vertical movements of the equipment support within the second range of movement and stabilize the equipment support during the vertical movements.

15. The apparatus of claim 14, wherein the range of movement for the work surface is approximately equal to the second range of movement for the equipment support.

16. The apparatus of claim 14, wherein the second actuator comprises at least one second linear actuator.

17. The apparatus of claim 16, wherein the at least one second linear actuator comprises ball screws or lead screws.

18. The apparatus of claim 14, wherein:

the second actuator comprises a second threaded rod that is rotatably mounted and vertically fixed in the second post between a second upper rotational bearing contained in the upper portion of the frame and a second lower rotational bearing contained in the lower portion of the frame;

the second actuator member is operably attached to the second threaded rod and the equipment support so that rotation of the second threaded rod between the second upper rotational bearing and the second lower rotational bearing with the motor causes the vertical movements of the equipment support within the second range of movement; and the second actuator member comprises threads that are operable with corresponding threads of the second threaded rod to:

cause the vertical movements of the equipment support when the second threaded rod is rotated;

stabilize the equipment support during the vertical movements; and maintain a vertical position of the equipment support at each height of the plurality of different equipment support heights when the second threaded rod is not rotated.

19. The apparatus of claim 18, comprising:

a second elongated opening extending into the second post; and a second connector that extends through the second elongated opening and is attached to the second actuator member so that equipment support is vertically supported by the second actuator member.

20. The apparatus of claim 14, wherein the second actuator member comprises one or more of:

exterior surfaces that act on the second post to maintain the orientation of and stabilize the equipment support during the vertical movements of the equipment support;

a plurality of wheels that act on the second post to stabilize the equipment support during the vertical movements of the equipment support; and axles extending through the second actuator member to position the plurality of wheels against interior surfaces of the second post.

21. The apparatus of claim 13, wherein the plurality of different equipment support heights comprise one or more of:

an equipment standing position where the equipment support is moved vertically away from a floor to an equipment standing height;

an equipment squat position where the equipment support is moved vertically toward the floor to an equipment floor height;

an equipment seated position where the equipment support is moved vertically away from the equipment standing height or the equipment floor height to an equipment seated height; and an equipment ceiling position where the equipment support is moved vertically away from the floor to an equipment ceiling height that is above the equipment standing height, the equipment seated height, and the equipment floor height.

22. The apparatus of claim 13, wherein:

the actuator is electronically operable to move the work surface within the range of movement in response to one or more of a switch, a timer, a sensor, a programmable controller, and a mobile device; and the second actuator is electronically operable to move the equipment support within the second range of movement in response to one or more of the switch, the timer, the sensor, the programmable controller, and the mobile device.

23. The apparatus of claim 22, wherein the second actuator comprises a second linear actuator operable with an input torque applied by the second motor to cause the vertical movements of the equipment support within the second range of movement.

* * * * *